US009874417B2

(12) United States Patent
Zajk et al.

(10) Patent No.: US 9,874,417 B2
(45) Date of Patent: Jan. 23, 2018

(54) FIRING CONTROL SYSTEM FOR FIREARM

(71) Applicant: Sturm, Ruger & Company, Inc., Southport, CT (US)

(72) Inventors: Joseph J. Zajk, Prescott, AZ (US); Darin Nebeker, Gilbert, AZ (US); Samuel Vavro, Dacono, CO (US); James B. Higley, Dyer, IN (US)

(73) Assignee: STURM, RUGER & COMPANY, INC.

( * ) Notice: Subject to any disclaimer, the term of this patent is extended or adjusted under 35 U.S.C. 154(b) by 0 days.

(21) Appl. No.: 15/392,578

(22) Filed: Dec. 28, 2016

(65) Prior Publication Data

US 2017/0184366 A1 Jun. 29, 2017

Related U.S. Application Data

(60) Provisional application No. 62/271,472, filed on Dec. 28, 2015.

(51) Int. Cl.
*F41A 19/32* (2006.01)
*F41A 17/56* (2006.01)

(52) U.S. Cl.
CPC ..... *F41A 19/32* (2013.01); *F41A 17/56* (2013.01)

(58) Field of Classification Search
CPC ..... F41A 17/00; F41A 17/56–17/58; F41A 17/64; F41A 19/12; F41A 19/31–19/32; F41A 19/44–19/45
USPC ..... 42/69.02, 70.04–70.05; 89/132, 139, 89/149–150
See application file for complete search history.

(56) References Cited

U.S. PATENT DOCUMENTS 2,090,656 A * 8/1937 Williams ..... F41A 5/24 42/16
2,780,965 A * 2/1957 Kunz ..... F41A 19/45 42/69.01
2,975,680 A * 3/1961 Wilson ..... F41A 3/38 42/25
4,703,826 A 11/1987 Byron
5,183,959 A 2/1993 McCoan
(Continued)

OTHER PUBLICATIONS

Corresponding International Search Report and Written Opinion for PCT/US2016/068857 dated Mar. 13, 2017.

*Primary Examiner* — Stephen Johnson
*Assistant Examiner* — Benjamin S Gomberg
(74) *Attorney, Agent, or Firm* — The Belles Group, P.C.

(57) ABSTRACT

A firing control system for a firearm includes a frame, a barrel with chamber configured for holding a cartridge, a spring-biased striker movable forward and rearward in a linear path along a longitudinal axis, a trigger mechanism comprising a trigger, a pivotable sear, a pivotable sear connector engaged with the sear, a sear pivotable connector blocker engaged with the sear connector, and a linearly movable sear connector actuator engageable with and operable to move the sear connector and sear connector blocker. Pulling the trigger slides the sear connector actuator which in sequence engages and rotates the sear connector blocker to disengage the sear connector, and engage and rotate the sear connector to disengage the sear and release the striker from a cocked position to discharge the firearm. In the absence of a trigger pull, the sear connector blocker remains engaged with the sear connector to prevent firing the firearm.

23 Claims, 35 Drawing Sheets

(56) References Cited

U.S. PATENT DOCUMENTS

| | | | | |
|---|---|---|---|---|
| 6,256,918 | B1 * | 7/2001 | Szabo | F41A 17/72 42/69.03 |
| 7,234,261 | B2 * | 6/2007 | McGarry | F41A 17/02 42/70.05 |
| 7,617,628 | B2 | 11/2009 | Curry | |
| 2015/0068092 | A1 | 3/2015 | Kallio | |
| 2016/0298916 | A1 * | 10/2016 | Anderson | F41A 17/56 |
| 2017/0059267 | A1 * | 3/2017 | Hudson, III | F41A 19/12 |

* cited by examiner

FIG. 42
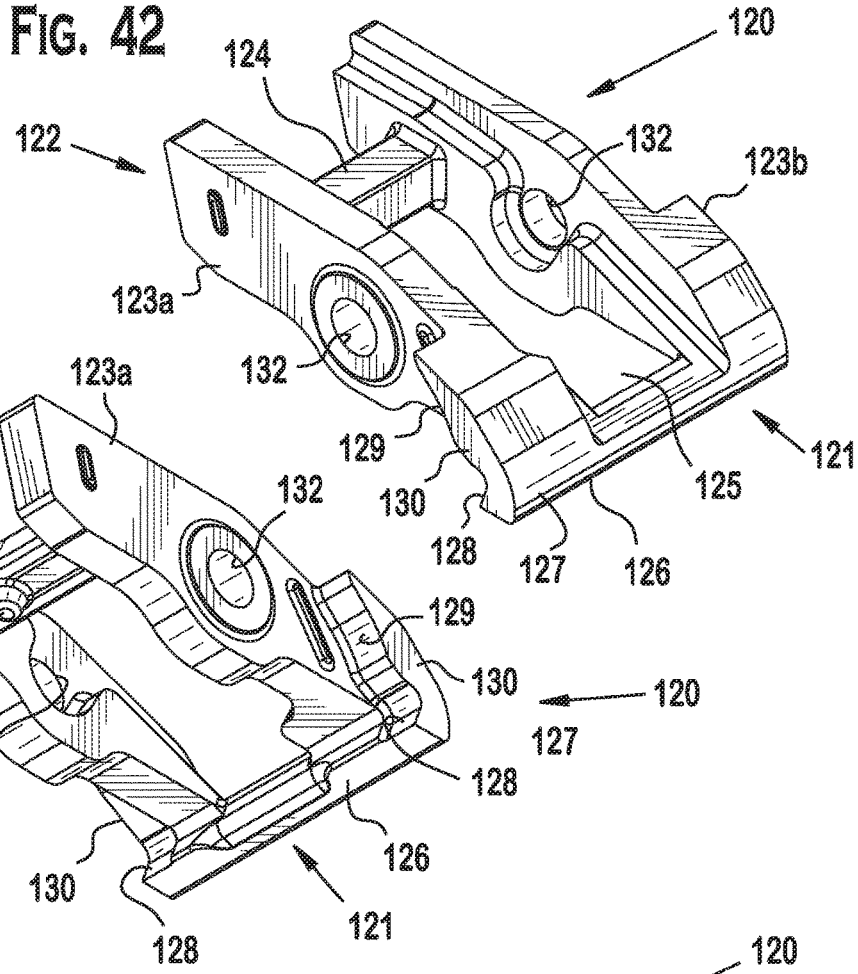
FIG. 43
FIG. 44
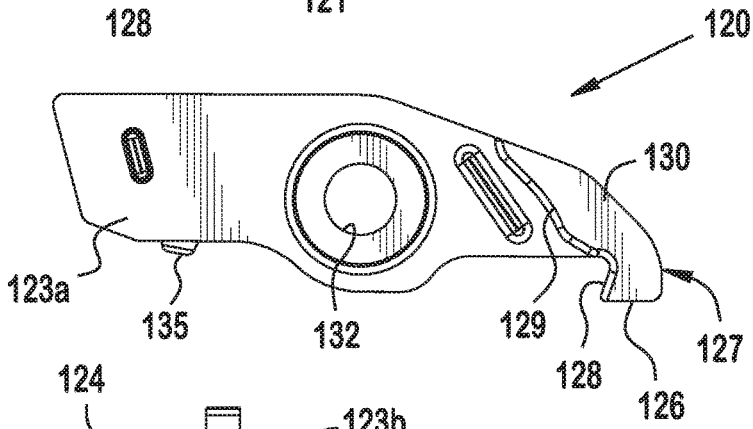
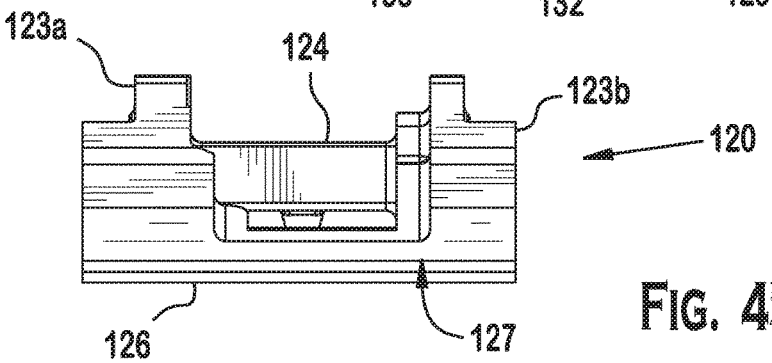
FIG. 45

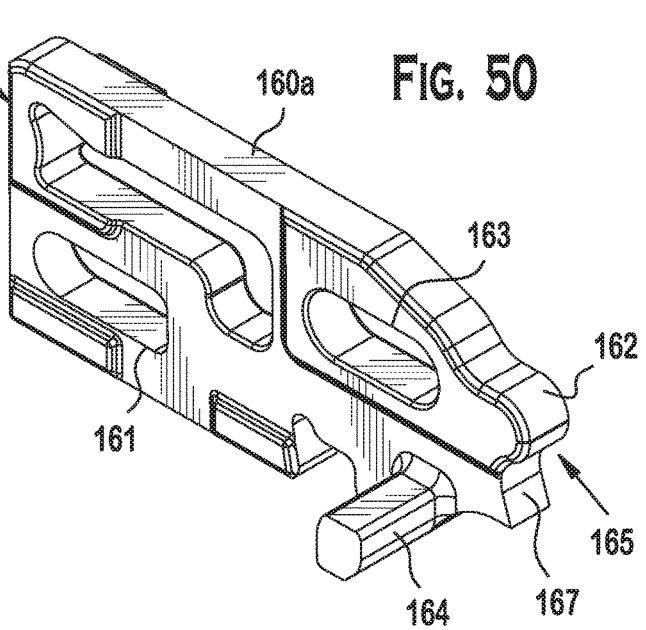
FIG. 50
FIG. 51
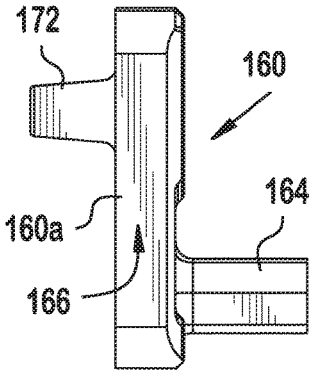
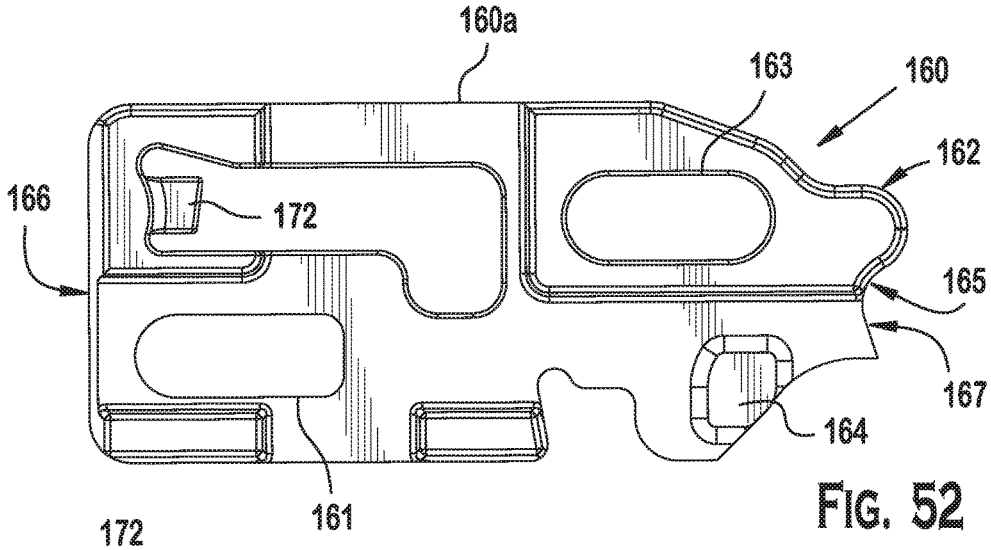
FIG. 52
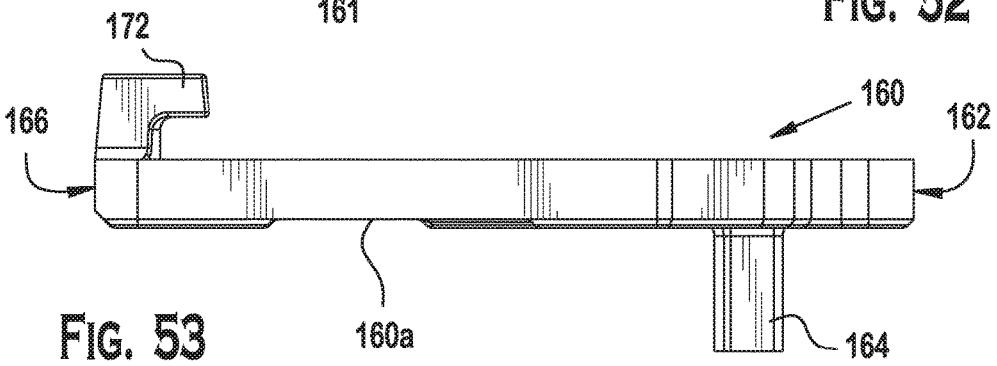
FIG. 53

FIRING CONTROL SYSTEM FOR FIREARM

CROSS-REFERENCE TO RELATED APPLICATIONS

The present application claims the benefit of priority to U.S. Provisional Application No. 62/271,472, filed Dec. 28, 2015, which is incorporated herein by reference in its entirety.

BACKGROUND OF THE INVENTION

The present invention generally relates to firearms, and more particularly to firing mechanisms suitable for auto-loading pistols.

Firearms such as semiautomatic auto-loading pistols come in a variety of full size and compact platforms for concealed carry applications. One type of firing mechanism used in pistols rely on a pivotable hammer which is held in a rear cocked and ready-to-fire position. To discharge the pistol, the hammer is released from a cocked position via a trigger pull which impacts and drives a firing pin forward to contact and detonate a chambered ammunition cartridge. Alternatively, "striker-fired" pistols have a somewhat more simplified firing mechanism which utilize a linearly movable striker that is held in a cocked position. Pulling the trigger releases the striker to directly contact and detonate a chambered ammunition round.

An improved firing control system for a striker-fired firearm is desired.

SUMMARY OF THE INVENTION

According various aspects of the invention, an auto-loading firearm is provided having an improved firing control system with blocker mechanism. A related method of operation is further disclosed. In one non-limiting embodiment, the firearm may be a pistol.

In one aspect, an auto-loading firearm with firing control mechanism includes: a longitudinal axis; a frame; a barrel supported by the frame and defining a chamber for holding a cartridge; a trigger mechanism including a trigger movably mounted to the frame; a spring-biased striker movable axially along the longitudinal axis in a linear path between a rearward cocked position and a forward firing position for striking a chambered cartridge; a sear pivotably movable between an engaged position that holds the striker in the cocked position and a release position that releases the striker from the cocked position to fire the firearm; a sear connector operably linked to the firing mechanism and pivotably movable into and out of engagement with the sear, the sear connector biased into engagement with the sear which prevents movement of the sear; the sear when disengaged by the sear connector via operation of the trigger mechanism pivotably moving to release the striker for firing the firearm; a sear connector blocker operably coupled to the trigger mechanism and movable into and out of engagement with the sear connector, the sear connector blocker being movable via operation of the trigger between a blocking position preventing movement of the sear connector and a non-blocking position allowing the sear connector to move and disengage the sear; wherein pulling the trigger moves the sear connector blocker from the blocking position to the non-blocking position and disengages the sear connector from the sear which is released to discharge the firearm.

In another aspect, a firing control assembly for an auto-loading firearm includes: a longitudinal axis; a firing control housing configured for insertion into a frame of a firearm; a sear disposed in the firing control housing and pivotably movable about a first transversely oriented pivot pin, the sear including an upwardly extending catch protrusion arranged and operable to selectively engage a striker movable along the longitudinal axis in a linear path from a rearward cocked position to a forward firing position for striking a chambered cartridge; the sear rotatable between an upright engaged position to hold the striker in the cocked position and a downward release position to release the striker from the cocked position to discharge the firearm; a sear connector disposed in the firing control housing and pivotably movable about a second transversely oriented pivot pin, the sear connector including an upwardly projecting operating arm and a latching surface biased rearward into engagement with the sear to prevent movement thereof; a sear connector blocker disposed in the firing control housing and pivotably movable about a transversely oriented third pivot pin, the sear connector blocker including a front downwardly projecting hooked portion configured and arranged to selectively engage the upwardly projecting operating arm of the sear connector; the sear connector blocker being movable between a blocking position engaging and preventing movement of the sear connector and a non-blocking position disengaging and allowing movement of the sear connector to disengage the sear; a sear connector actuator linearly movable in the firing control housing along the longitudinal axis between a rearward axial position and a forward axial position, the sear connector actuator engageable with the sear connector and sear connector blocker; wherein linearly moving the sear connector actuator from the rearward to forward axial position engages and moves the sear connector blocker from the blocking position to the non-blocking position, and further engages and moves the sear connector to disengage the sear which rotates to release the striker.

A method for discharging a firearm is provided. The method includes: providing a firearm including a frame, a barrel with chamber configured for holding a cartridge, a spring-biased striker movable forward and rearward in a linear path along a longitudinal axis, a trigger mechanism comprising a trigger, a pivotable sear, a pivotable sear connector engaged with the sear, a sear pivotable connector blocker engaged with the sear connector, and a linearly movable sear connector actuator engageable with the sear connector and sear connector blocker; engaging the sear with the striker to hold the striker in a rearward cocked position; actuating the trigger; sliding the sear connector actuator in an axial direction; engaging and rotating the sear connector blocker with the sear connector actuator which disengages the sear connector; further sliding the sear connector actuator in the axial direction; engaging and rotating the sear connector with the sear connector actuator which disengages the sear after the sear connector actuator engages the sear connector blocker; rotating the sear which disengages the striker; and moving the striker forward for striking a cartridge in the chamber.

BRIEF DESCRIPTION OF THE DRAWINGS

The features of the preferred embodiments will be described with reference to the following drawings where like elements are labeled similarly, and in which:

FIG. 42 is a top front perspective view of the sear connector blocker;

FIG. 43 is a rear bottom perspective view thereof;

FIG. 44 is a right side view thereof;

FIG. 45 is a front view thereof;

FIG. 50 is a front right perspective view of a right member of a sear connector actuator;

FIG. 51 is a rear view thereof;

FIG. 52 is a right side view thereof;

FIG. 53 is a top plan view thereof;

Figure 1:
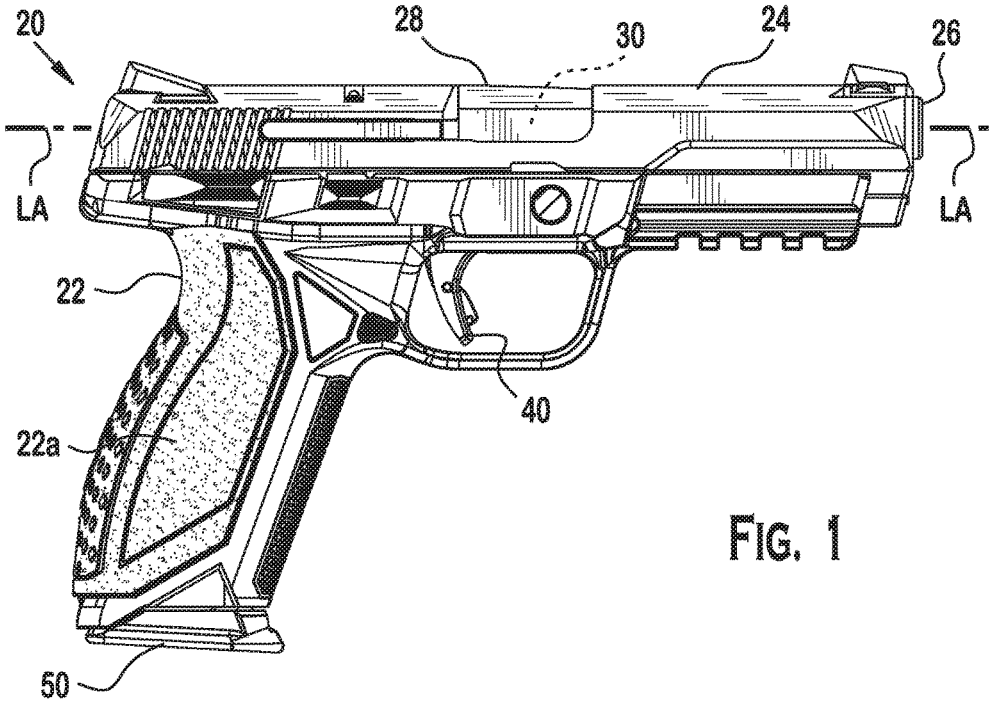
FIG. 1 is a right side view of a pistol according to the present disclosure.

All drawing shown herein are schematic and not to scale. A reference to certain figures in the Detailed Description which follows shall be construed as examples where certain components are shown recognizing that the components may appear in other figures.

DETAILED DESCRIPTION

The features and benefits of the invention are illustrated and described herein by reference to preferred embodiments. This description of preferred embodiments is intended to be read in connection with the accompanying drawings, which are to be considered part of the entire written description. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

In the description of embodiments disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures may be secured or attached to one another either directly or indirectly through intervening structures, as well as both movable or rigid attachments or relationships, unless expressly described otherwise. As the terms are used herein, "forward" indicates an axial direction towards the muzzle end of the firearm and "rearward" indicates an opposite axial direction.

An exemplary auto-loading firearm incorporating an embodiment of a firing control mechanism according to the present disclosure will now be described with non-limiting reference to a semi-automatic pistol. The principles and features of the embodiments disclosed herein, however, may be embodied with equal benefit in other types of auto-loading firearms such as rifles. Accordingly, the invention is not limited in its applicability or scope to pistols alone as described herein.

Figure 2:
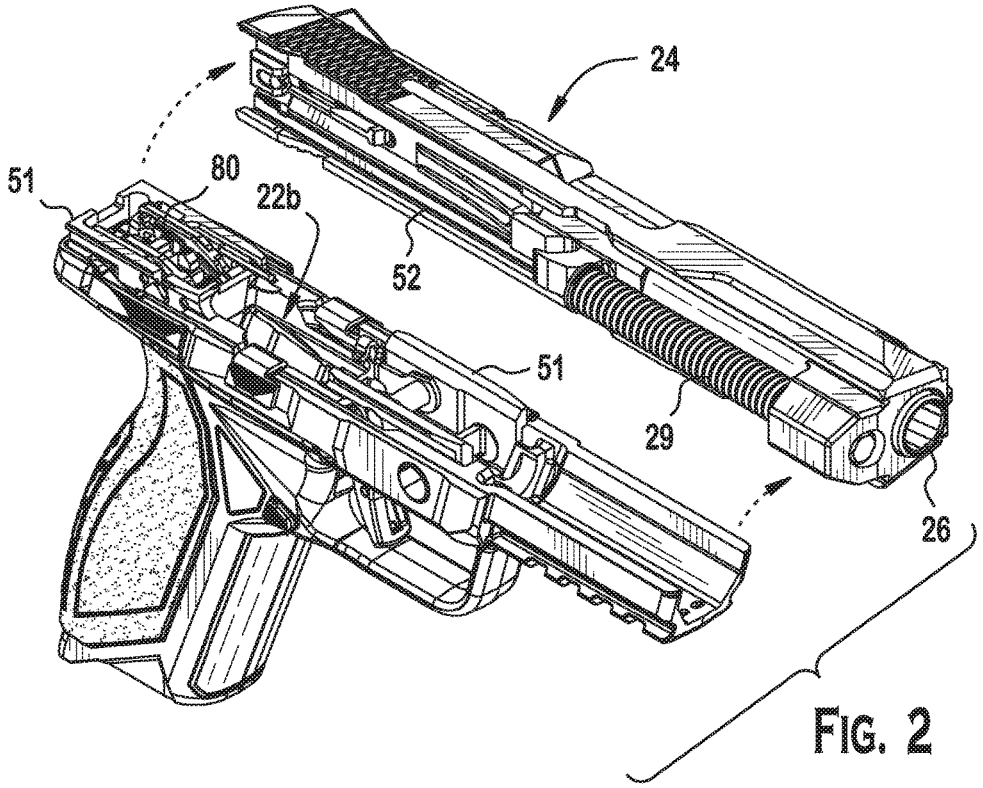
FIG. 2 is a right side exploded perspective view thereof showing the slide removed and rotated 90 degrees.

FIG. 1 depicts a right side view of an auto-loading pistol 20 including a firing control mechanism according to the present disclosure. FIG. 2 depicts the pistol with the slide removed from the grip frame and rotated 90 degrees to better show the bottom of the slide.

Figure 7:
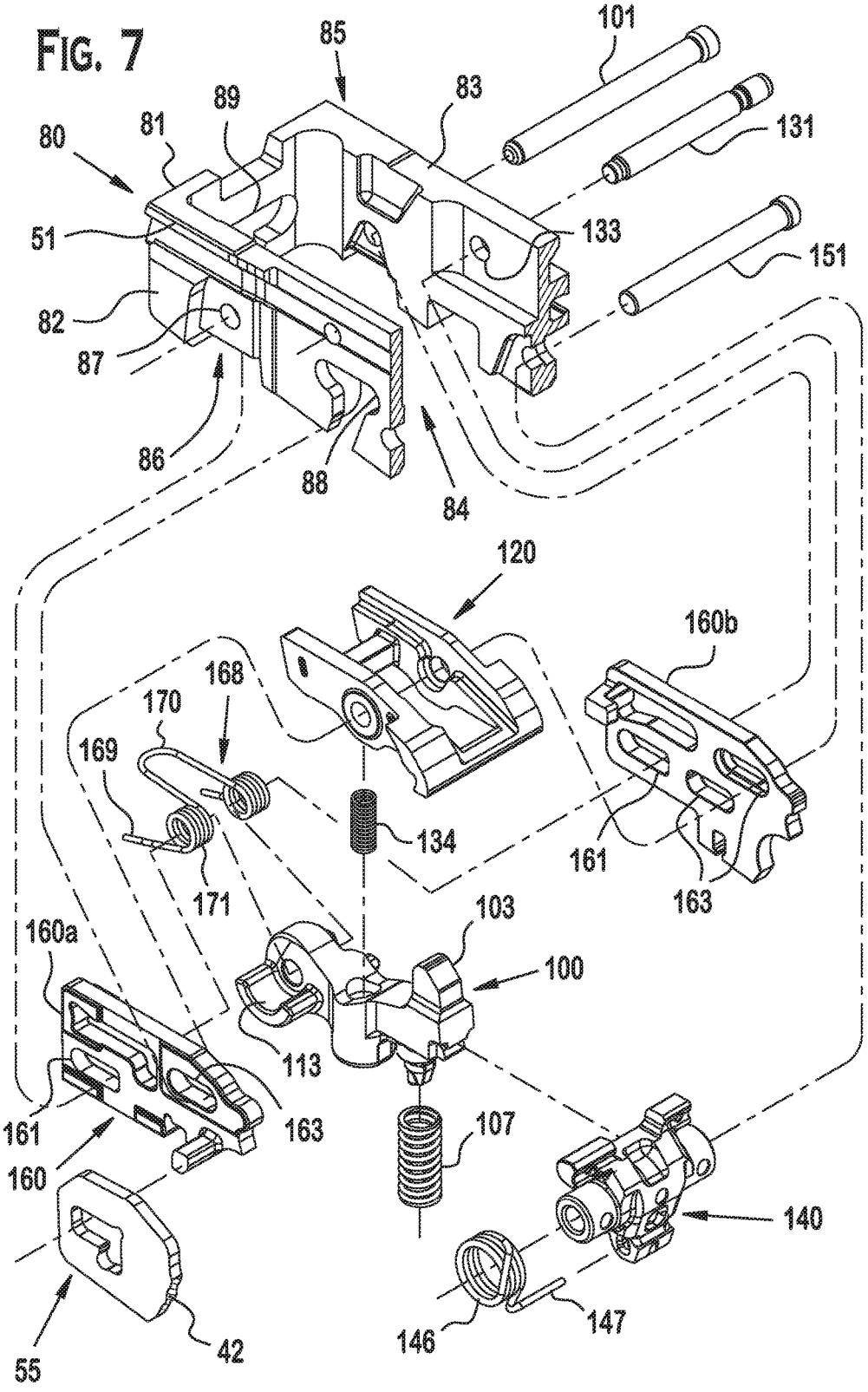
FIG. 7 is an exploded perspective view of the firing mechanism and firing control housing insert.
Figure 8:
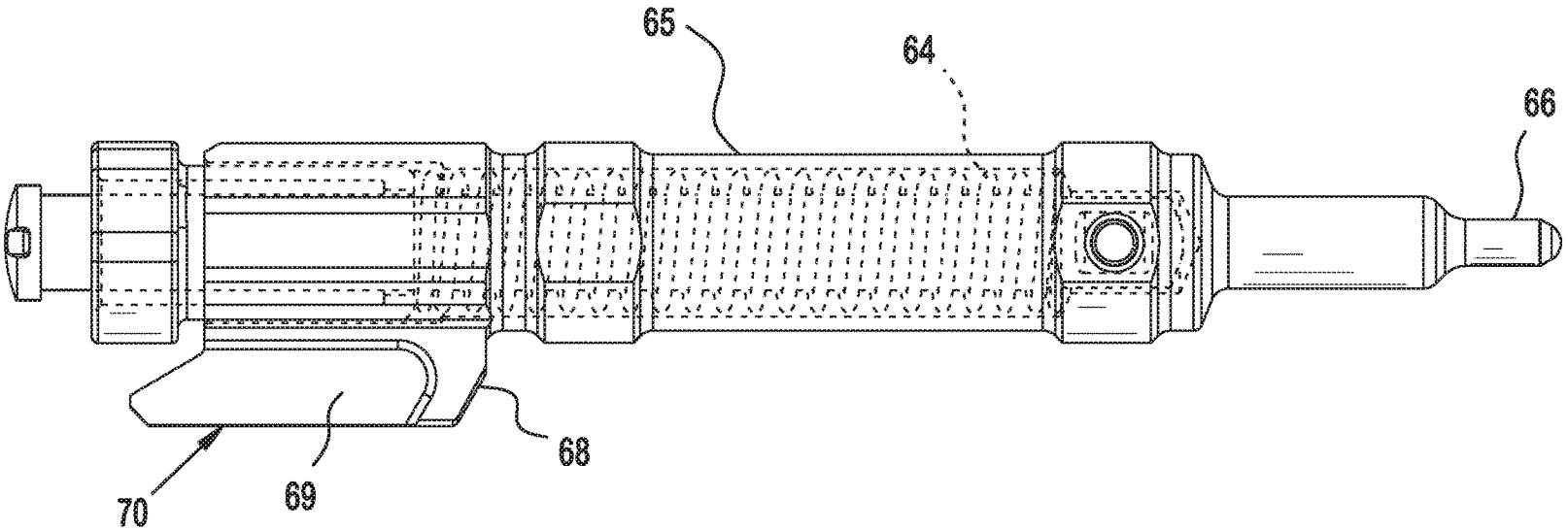
FIG. 8 is a right side view of the striker.

Referring now to FIGS. 1-2, pistol 20 includes a grip frame 22 having a rear downwardly extending grip portion 22*a* for grasping and an elongated longitudinally-extending cavity 22*b* which opens upwards and receives firing control housing insert 80 therein (see FIG. 7). Firing control housing insert 80 supports various firing control mechanism components which advantageously may be mounted therein prior to installing the insert into the frame 22 to facilitate assembly of the pistol. Accordingly, the firing control housing insert 80 with firing control mechanism components is mountable in and removable from frame 22 as a unit. Advantageously, this allows the firing control components to be pre-mounted in the insert 80 in a simplified and more readily accessible manner rather than mounting the components individually in the frame 22.

Referring to FIG. 7, firing control housing insert 80 has a generally axially elongated body in one embodiment including front portion and a rear portion having a rear wall 81 and two opposing spaced apart sidewalls 82, 83 projecting in a forward direction from the rear wall. The rear wall and sidewalls define an interior space 84 configured and dimensioned for housing and supporting the firing control components, as further described herein. The top and bottom 85, 86 of the insert may be open in one embodiment. Various apertures and slots may be formed in the firing control housing insert 80 for mounting the insert in cavity 22*b* of frame 22 and mounting the firing control components. Other suitable configurations and shapes may be used for the firing control housing insert depending on the firing control components to be housed therein. Accordingly, the invention is not so limited in that regard.

Firing control housing insert 80 may be made of any suitable metallic or non-metallic material suitable for stably and movably supporting the firing control components without failure after repeated firing of the pistol 20. In one exemplary embodiment, the insert may be made of metal such as without limitation aluminum, steel, titanium, or other. Examples of non-metallic materials that may be used includes polymers and composites.

Referring to FIGS. 1-2 and 26-27, slide 24 is slidably mounted on pistol 20 via a pair of laterally spaced apart opposing longitudinal support rails 51 and mating longitudinal grooves 52 formed on the underside of the slide for axial reciprocating movement forwards and rearwards thereon in a manner well known in the art. In one non-limiting embodiment, at least a portion of the rails 51 may be formed on the firing control housing 80 and other portions on the frame 22 (see also FIG. 7). A longitudinally extending elongated pocket 25 is formed on the right bottom surface 27 of slide 24 between its front and rear ends (closer to the rear in one embodiment). Pocket 25 is positioned for receiving the top portion of bulbous rear end 55 of trigger bar 42 when the pistol 20 is in the cocked ready-to-fire position allowing the trigger bar to be in an upward spring-biased position, as further described herein.

Recoil spring 29 operably associated with slide 24 acts to return the slide to the forward position shown in FIG. 1 after discharging pistol 20. A magazine 50 may be removably inserted into a generally vertical magazine well formed inside grip frame 22 in a known manner. Magazine 50 is sized and configured for holding and dispensing a plurality of ammunition cartridges.

Figure 18:
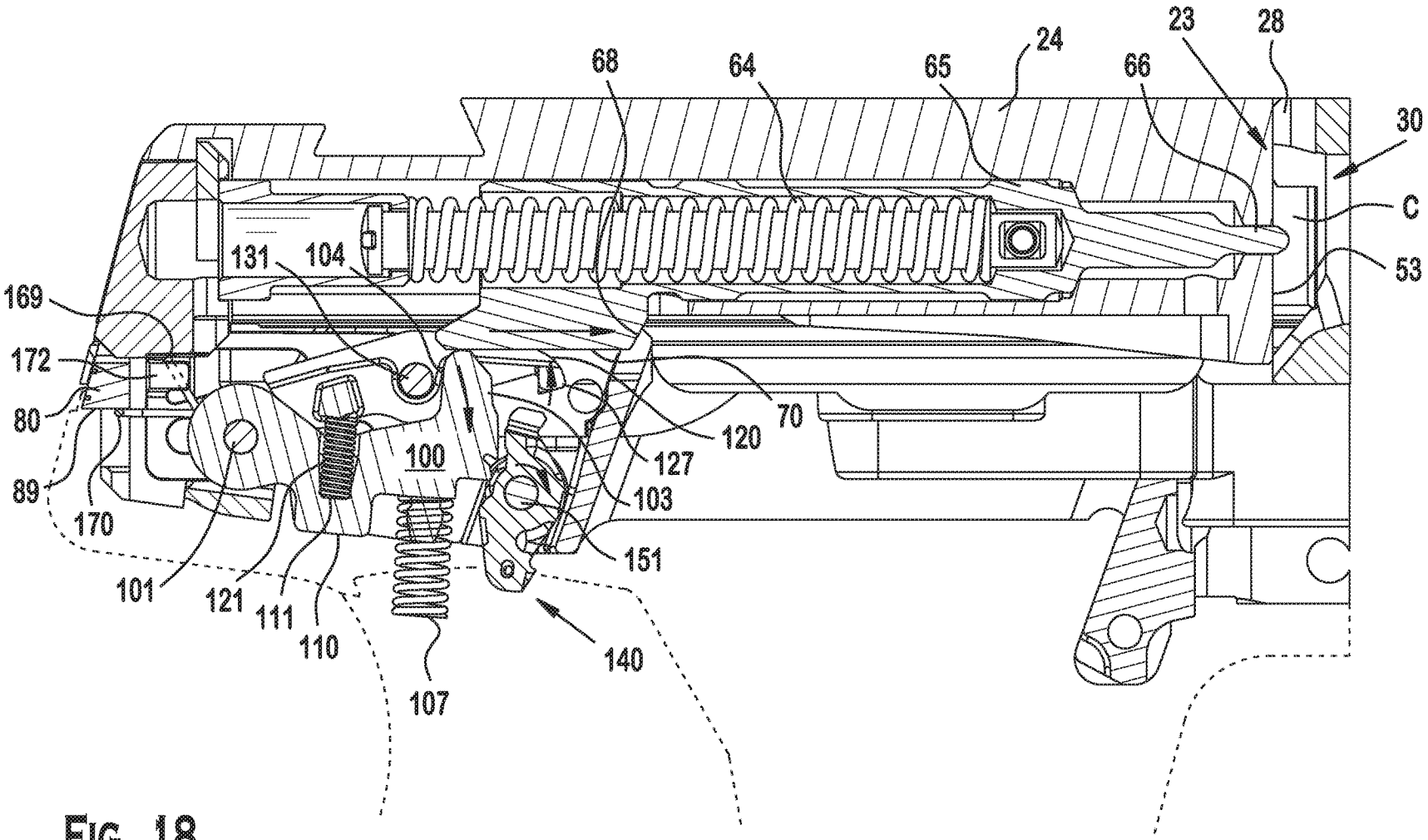
FIG. 18 is a right side view thereof with sear connector actuator removed to reveal the remaining firing mechanism components behind the sear connector actuator.
Figure 19:
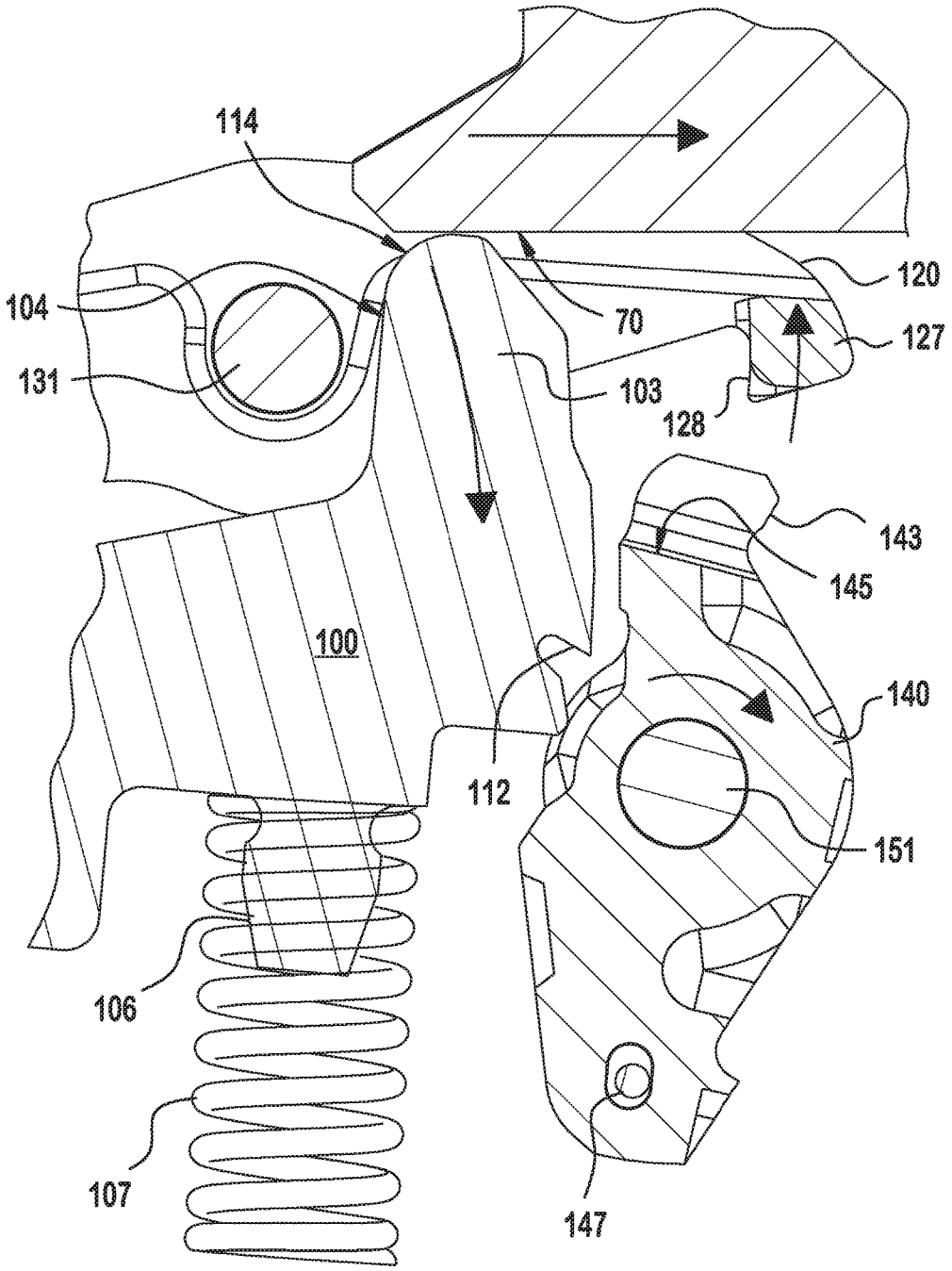
FIG. 19 is a detailed partial view thereof showing firing mechanism components in the third position.
Figure 20:
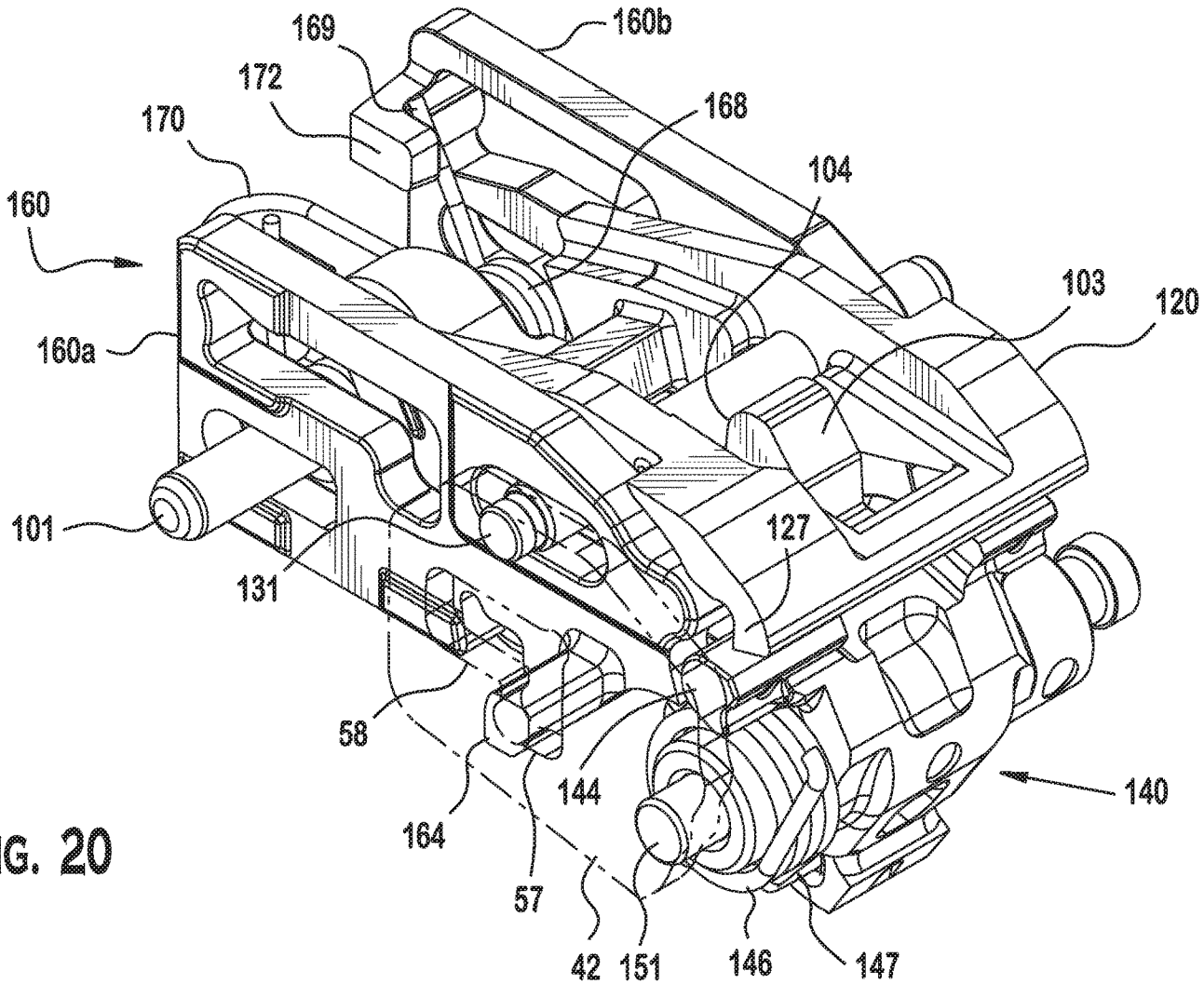
FIG. 20 is a front top perspective view thereof showing the entire firing mechanism.

Pistol 20 further includes a barrel 26 having an axial bore defining a pathway for a projectile. Barrel 26 is movably disposed at least partially inside slide 24. Pistol 20 defines a longitudinal axis LA (and axial direction) which is concentrically aligned with barrel 26 and slide 24 as shown in FIG. 1. Barrel 26 is moveable rearwards at least partially with slide 24 in relation to frame 22 under recoil after discharging pistol 20 or when manually cycling the action. A rear chamber block 28 is formed in barrel 26 defining a rearwardly open chamber 30 therein configured for receiving a cartridge (reference also FIG. 18). A breech area 23 is defined at the rear of barrel 26 and chamber 30 in the slide 24 for loading cartridges therein from magazine 50. Slide 24 includes a breech block defining a breech face 53 which is axially moveable with the slide in relation to the chamber 30 to alternatingly form an open or closed breech in a manner well known in the art. Breech block 53 includes a frontal hole through which the tip of striker 65 may be projected forward to strike a chambered cartridge C.

Figure 3:
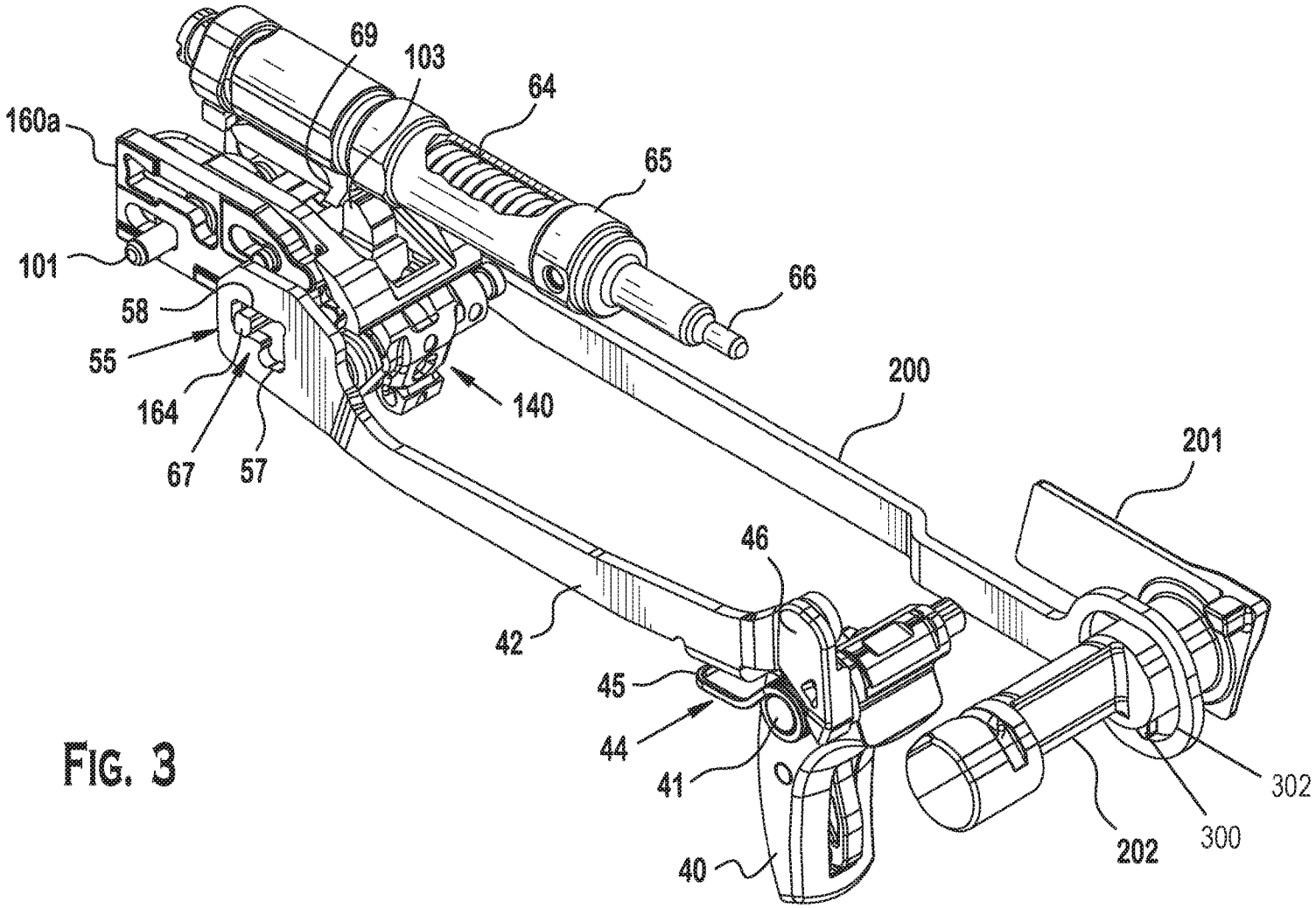
FIG. 3 is right perspective view of the firing and trigger mechanisms.
Figure 4:
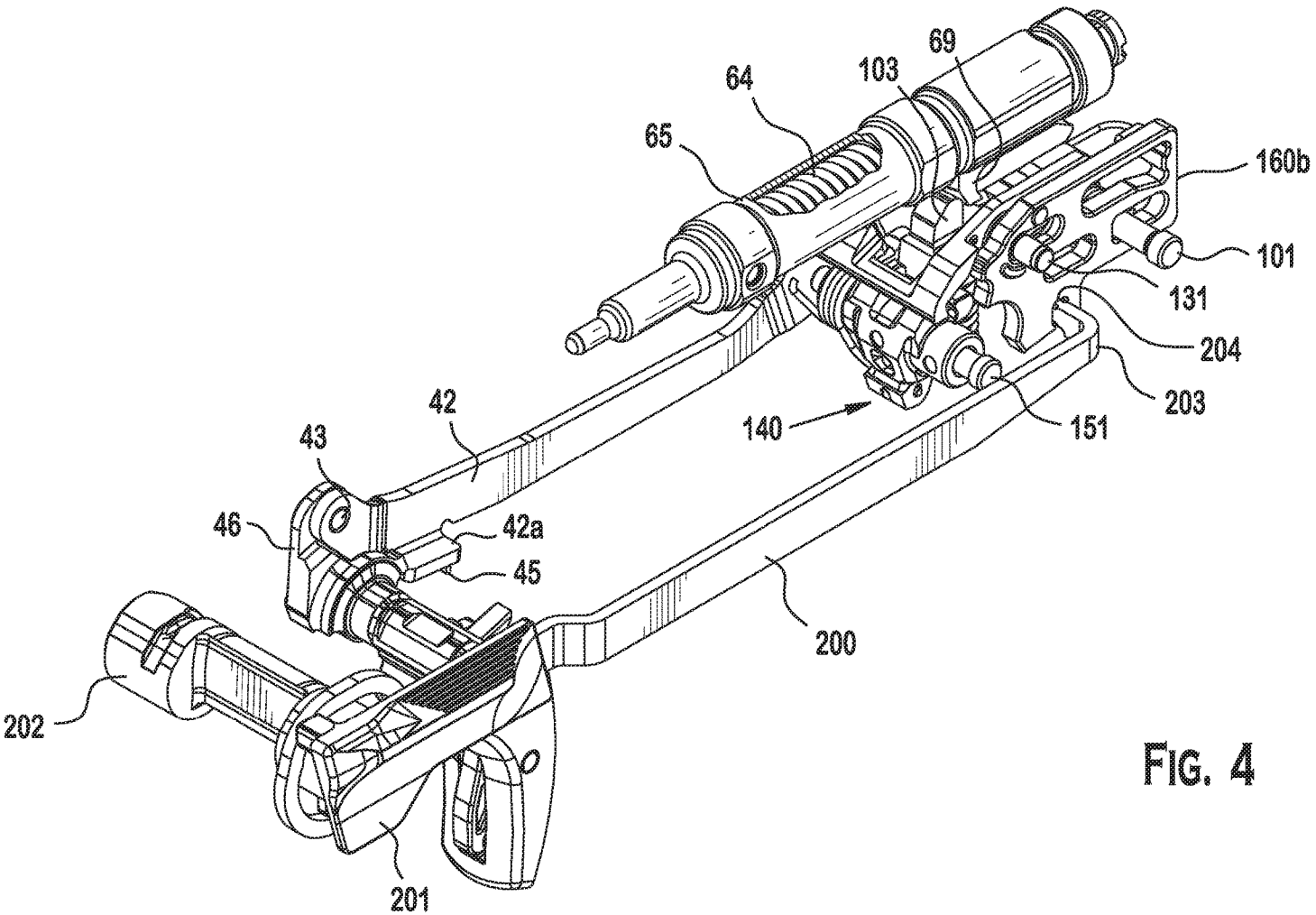
FIG. 4 is a left perspective view thereof.
Figure 5:
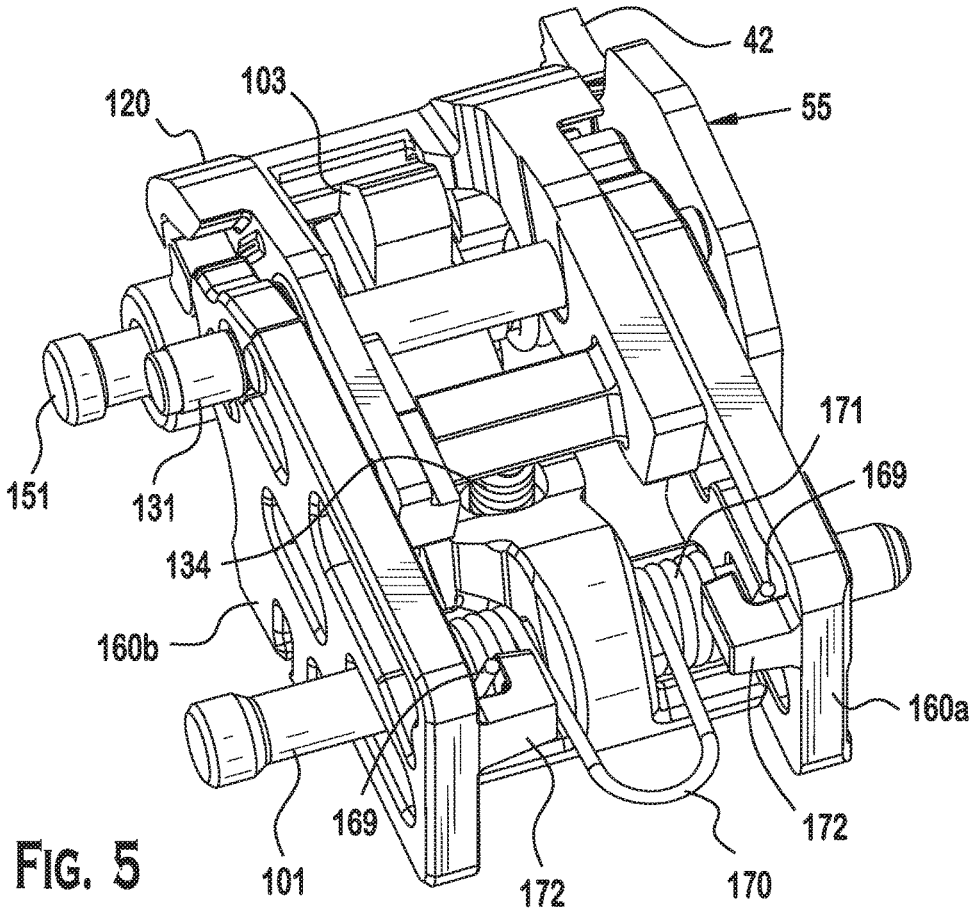
FIG. 5 is a top perspective view of the firing mechanism assembly.
Figure 6:
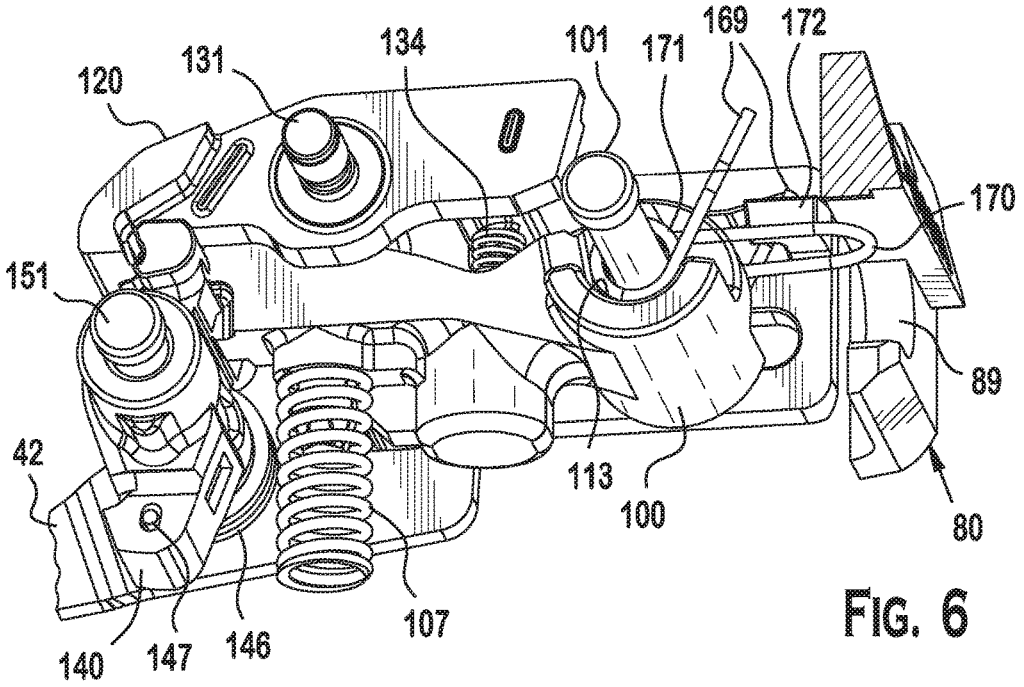
FIG. 6 is a left partial perspective view thereof.

FIGS. 3-4 show the firing control mechanism disembodied from the pistol grip frame 22 and firing control housing insert 80 for clarity.

Referring to FIGS. 1-4, a firing control mechanism in one embodiment includes a trigger assembly including a trigger 40 pivotally mounted in frame 22 to firing control housing 80 via transverse pin 41 and an axially (longitudinally) movable trigger bar 42 pivotally coupled to the trigger via transverse pin 43 on an upward trigger pivot extension 46. An axially linearly movable spring-loaded striker 65 is supported by slide 24 for rearward retraction/recoil and forward release to strike a chambered cartridge for discharging pistol 20. The striker 65 is actuated and released via the trigger assembly through a trigger pull. Accordingly, the combination of the trigger assembly and striker 65 together define a means for striking and igniting a chambered cartridge to discharge pistol 20.

Striker 65 has a generally cylindrical body and is axially elongated in structure. Referring further to FIGS. 8-11, Striker 65 may include a forward diametrically narrowed portion 66 which defines a terminal front tip configured to striker the primer cap of chambered cartridge C (see also FIG. 18). A downward projecting striker catch rail 69 is located on the bottom of the striker 65 for engaging the sear 100 to hold the striker in a cocked rearward ready-to-fire position (see also FIGS. 9-11). Catch rail 69 is axially elongated having a longitudinal flat bottom surface defining a cam track 70 and a flat obliquely angled sear bearing surface 68 at the front of the protrusion, both of which engage the sear 100 for different purposes during readying the pistol 20 for firing and subsequent discharge, as further described herein. Sear bearing surface 68 has a forward-downward facing angled orientation with respect to longitudinal axis LA and cam track 70 in one embodiment.

Accordingly, surface 68 therefore slopes downward from the top front portion to bottom rear portion. In other possible embodiments contemplated, sear bearing surface 68 may be convexly or concavely shaped rather than flat. Striker 65 is preferably made of a suitable metal, such as steel or other. The striker catch rail 69 may be a separate component fixedly attached to the striker 65 body or be an integral unitary structural part of the striker being formed with the body.

Striker spring 64 biases striker 65 with striker catch rail 69 forward for linear axial movement (i.e. along longitudinal axis LA) to strike a chambered cartridge when released via trigger pull. Spring 64 may be coiled concentrically around a portion of striker 65 in one embodiment. Striker spring 64 may be a helical compression coil spring in one embodiment, or other suitable type spring operable to bias the striker 65 forwards towards the chamber 30. Striker 65 may have a diametrically narrowed front end 66 configured to contact the rear of cartridge for detonation.

A trigger return spring 44 may further be provided which in one embodiment may be a torsion spring that is mounted about trigger pin 41 and biases trigger 40 toward the fully forward ready-to-fire position (see, e.g. FIGS. 3-4). With continuing reference to FIGS. 1-4, trigger spring 44 may further include a rearwardly extending leg 45 with a lateral extension which acts on the underside of trigger bar 42 to bias the trigger bar upwards. In one embodiment, leg 45 may engage the underside of a laterally inward extending protrusion 42*a* on trigger bar 42 as best shown in FIG. 4 to help maintain positive engagement between spring 44 and the trigger bar.

Referring to FIGS. 3-8, the firing control mechanism in one embodiment may include sear 100, sear blocker 120 (safety), sear connector 140, and sear connector actuator 160. Sear 100 is configured and operable to selectively retain and release the striker 65 from the rearward cocked position for firing the pistol 20. The sear blocker 120, sear connector 140, and sear connector actuator 160 interact and function to both actuate the sear for firing pistol 20 via a trigger pull and further to prevent unintentional discharge of the pistol in the absence of a trigger pull, as further described herein. These foregoing firing control components may be operably and moveably supported by firing control housing insert 80, described further below. It will be appreciated that in other possible embodiments, any or all of the foregoing firing control components may be supported directly by the frame 22. Although use of a firing control housing insert 80 is described herein in certain preferred embodiments, the insert may be entirely omitted in other less preferred but suitable embodiments in which the firing components are individually mounted directly in the frame.

Referring to FIGS. 3-11 and 28-34, sear 100 has a horizontally elongated body defining a front end 108 and rear end 109. Sear 100 is pivotably supported by the firing control housing insert 80 via transverse sear mounting pin 101 which passes through a lateral mounting hole 102 and defines a pivot axis. In one embodiment, mounting hole 102 may be disposed proximate to rear end 109 of the sear. Pin 101 further passes through opposing holes 87 in the sidewalls 82, 83 of the insert 80 and horizontally elongated slots 161 formed in right and left members 160*a*, 160*b* of sear connector actuator 160. The slotted arrangement of sear connector actuator 160 permit longitudinal linear movement of the actuator with respect to the sear pin 101, firing control housing insert 80, and frame 22 in response to a trigger pull for firing the pistol 20.

For engaging and holding the striker 65 in a cocked ready-to-fire position, sear 100 further includes an upward projecting catch protrusion 103 oriented transversely to longitudinal axis LA. Protrusion 103 defines a generally rearward facing striker catch surface 104 engageable with the generally forward facing sear bearing surface 68 formed on downward extending striker catch rail 69 on striker 65. In one embodiment, striker catch surface 104 may be disposed above and forward of sear pin 101 proximate to front end 108 of sear 100.

In one embodiment, striker catch surface 104 may include an arcuately-rounded top convex camming portion 114 positioned to engage sear bearing surface 68 and cam track 70 on striker 65. Camming portion 114 is formed above a vertical flat portion of surface 104 at or proximate to the top of catch protrusion 103 which may be rounded. The convex camming portion 114 contact with flat sear bearing surface 68 provides smooth engagement with the striker and operation of the firing mechanism. This angled flat-to-convex mating surface arrangement creates a line of action on the upward catch protrusion 103 of striker 100 that acts to rotate sear 100 downward and forward under the biasing force of striker spring 64 when the sear is released by the sear connector 140, as further described herein.

Sear 100 is biased in an upward and rearward counterclockwise direction about sear pin 101 by sear spring 107 (as viewed in FIGS. 3 and 9-11). In one embodiment, sear spring 107 may be a helical compression spring; however, other suitable types of springs including torsion springs may be used to bias sear 100 in the desired manner. Sear spring 107 may act on a downward facing bottom surface 105 on a front portion of sear 100 that disposed below upward catch protrusion 103 forward of sear pin 101. In one embodiment, spring 107 has a line of action which may be precisely or proximately vertically aligned with vertical striker catch surface 104 to create positive engagement with striker catch rail 69 when holding striker 65 in a cocked ready-to-fire position. A downwardly extending spring retention post 106 may be formed may be formed on bottom surface 105 of the sear to retain the upper end of spring 107 in the desired position.

Sear 100 may further include centrally located enlarged boss 110 which forms an upwardly open socket 111 configured for receiving and retaining sear blocker spring 134, further described herein. Boss 110 may be formed proximate to the midpoint between ends 108 and 109 of sear 100. In one embodiment, boss 110 includes a downward projecting portion which extends below mounting hole 102. The boss may have a generally cylindrical structure in one embodiment.

Sear 100 is pivotably moveable via a trigger pull between an upward engaged position holding the striker 65 in the rearward cocked position thereby preventing forward linear movement of the striker and a rotated downward release position thereby releasing the striker to strike and detonate chambered cartridge. In the engaged position, catch protrusion 103 of sear 100 is in a substantially vertically upright position. In the rotated release position, the catch protrusion 103 is moved lower than in the engaged position with respect to the longitudinal axis LA and frame 22 of the pistol 20.

Referring now to FIGS. 3-11 and 35-41, sear connector 140 operably interacts with and is configured to retain sear 100 in the upward engaged position until the connector is actuated by the sear connector actuator 160. Sear connector 140 is positioned forward of sear 100 in firing control housing insert 80. Sear connector 140 includes a top 148 and bottom 149. The sear connector 140 may have a laterally widened body including a lateral mounting hole 141 formed in a transversely extending central tubular portion 140*a* of the body for receiving transverse sear connector mounting pin 151 which defines a pivot axis. Mounting pin 151 is positioned forward and lower than sear mounting pin 101 in one non-limiting embodiment.

Sear connector 140 further also include a rear facing cam follower surface 142 and a front facing blocking surface 143. In one embodiment, a pair of each surfaces 142, 143 may be provided and laterally spaced apart on either side of a vertical centerline of the connector. Cam follower surface 142 may be convexly shaped in one configuration. Blocking surface 143 may be flat and obliquely angled (with respect to longitudinal axis LA) in one configuration to complement a mating flat and obliquely angled blocking surface 128 of sear blocker 120, as further described herein.

According to a non-limiting exemplary embodiment, the pair of sear connector surfaces 142, 143 may each be formed on opposite front and rear sides of a laterally spaced apart pair of laterally-elongated and oriented operating arms 144. Operating arms 144 each extend upwards and laterally outwards from the main body of the sear connector 140 (e.g. central tubular portion 140*a*). In other possible embodiments, a single continuous lateral operating arm 144 may be provided.

Figure 11:
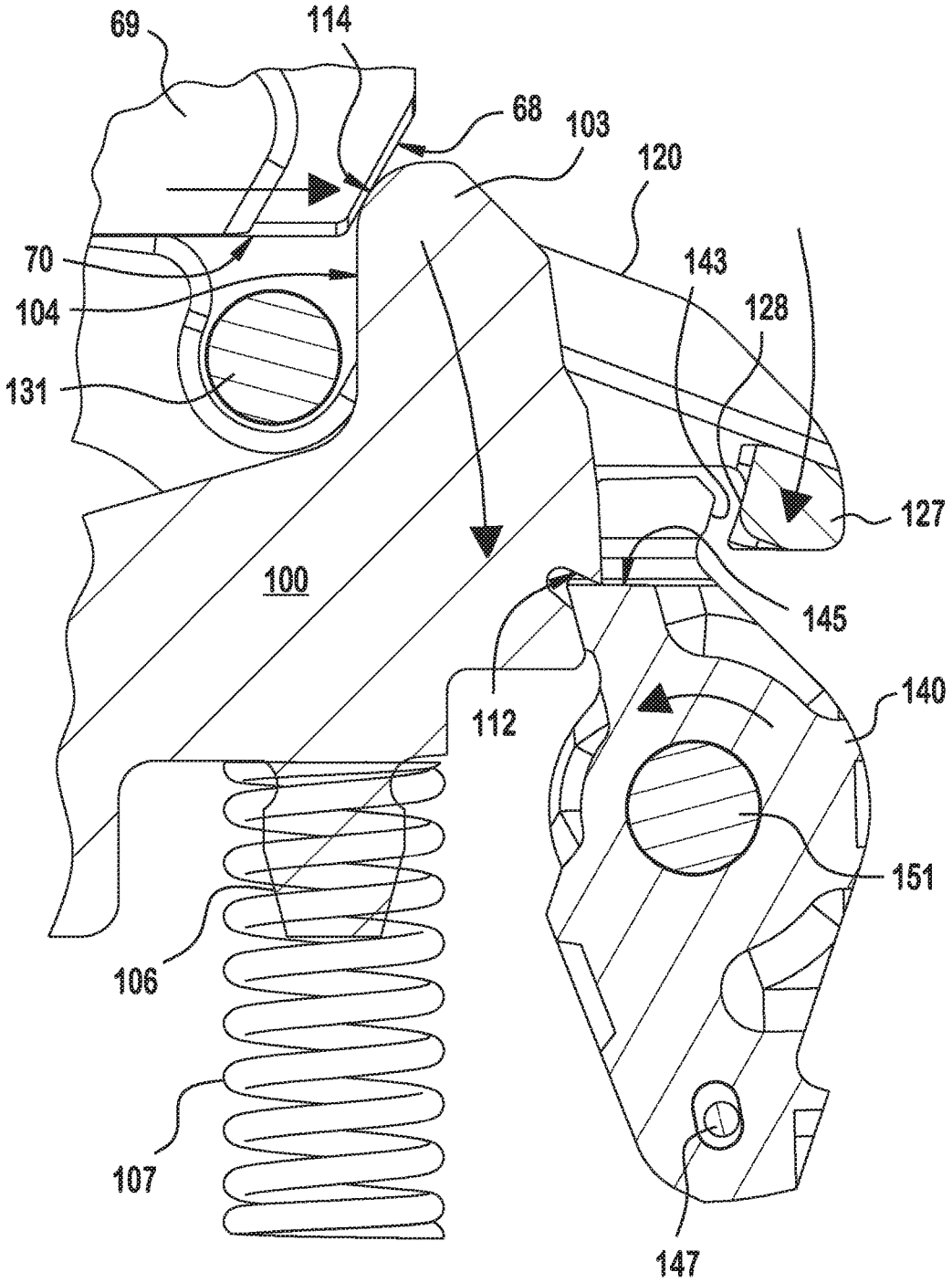
FIG. 11 is a detailed partial view thereof showing firing mechanism components in the first position.
Figure 12:
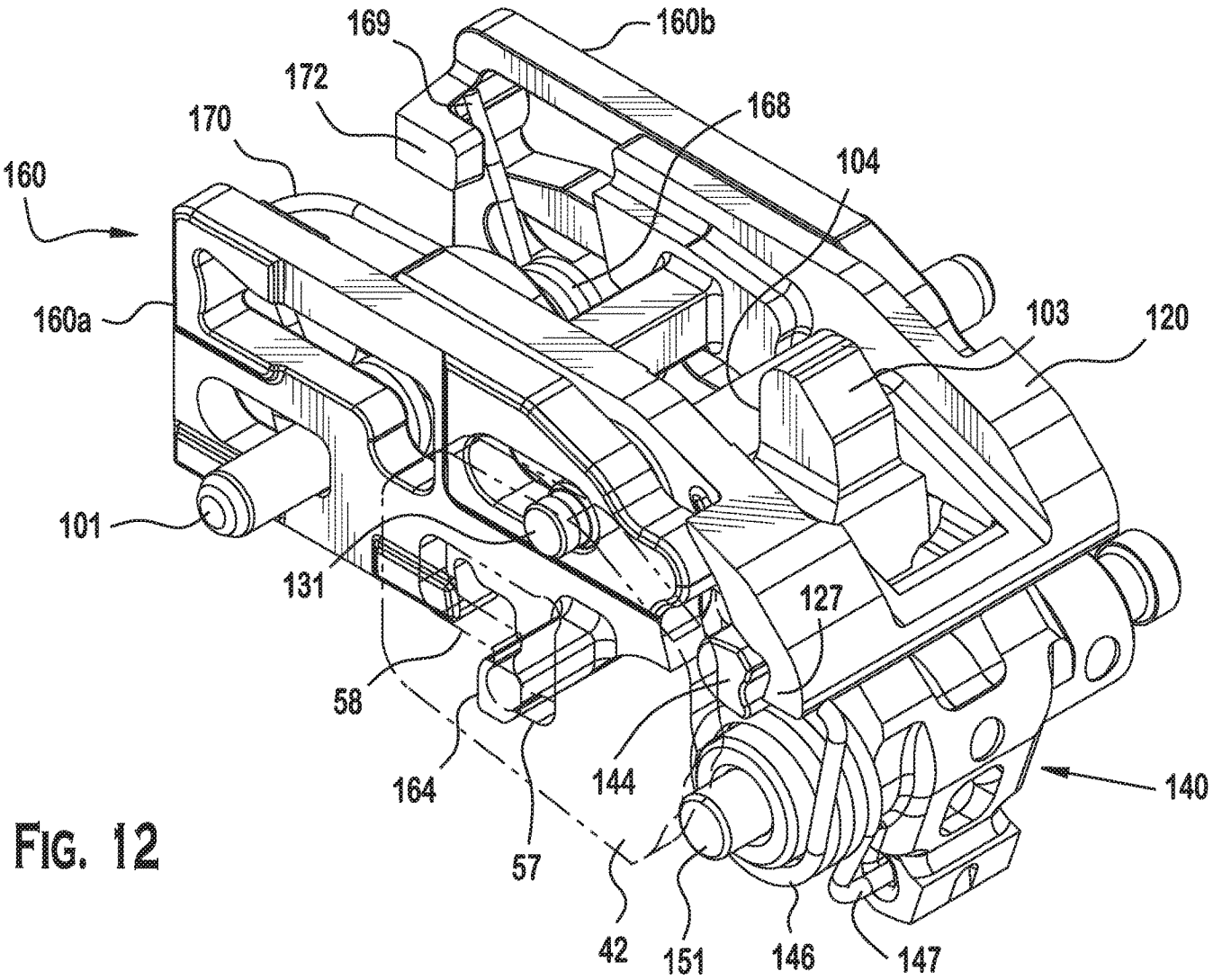
FIG. 12 is a front top perspective view thereof showing the entire firing mechanism.
Figure 13:
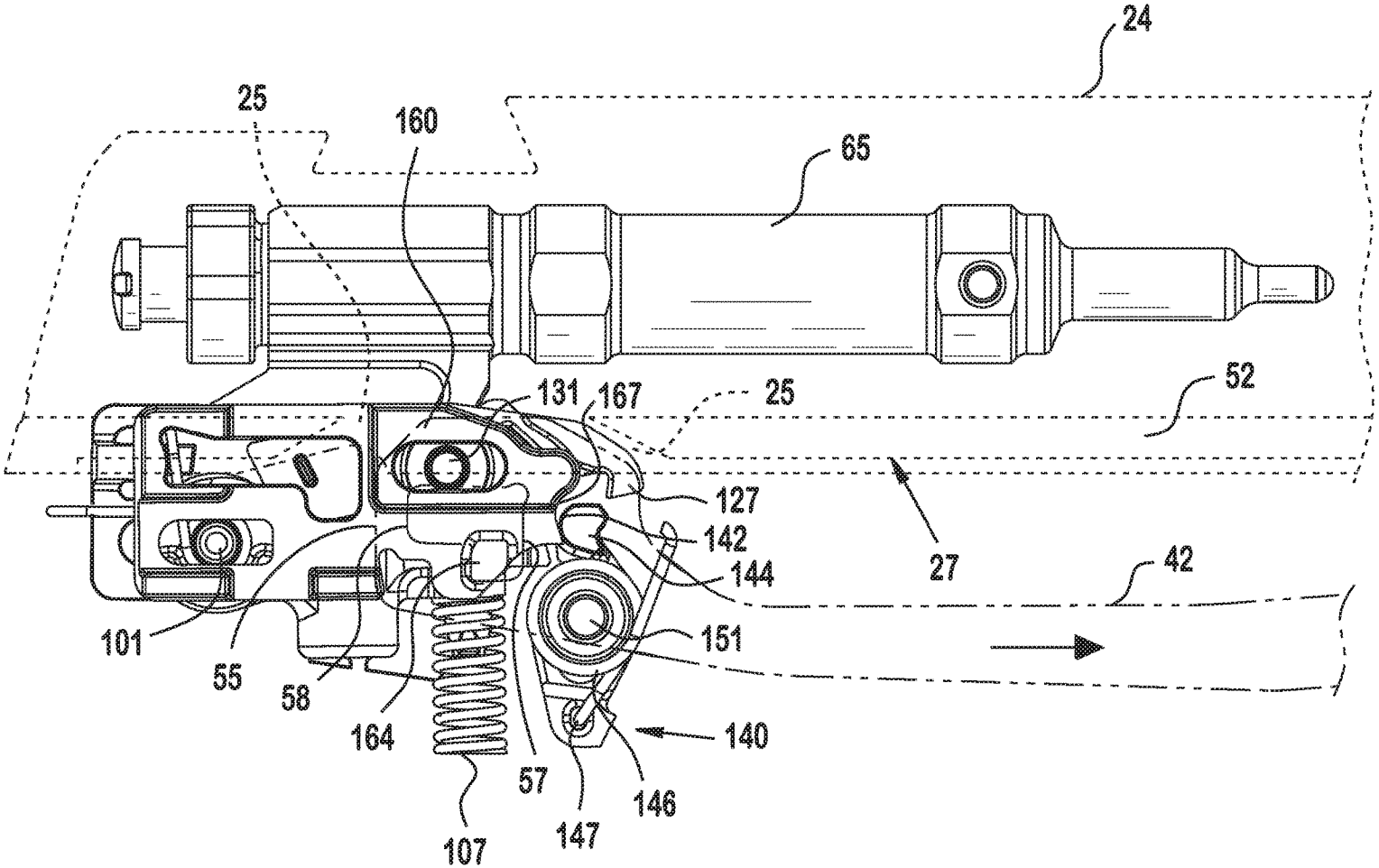
FIG. 13 is a right side view of the striker and the firing mechanism in a second operational position.
Figure 14:
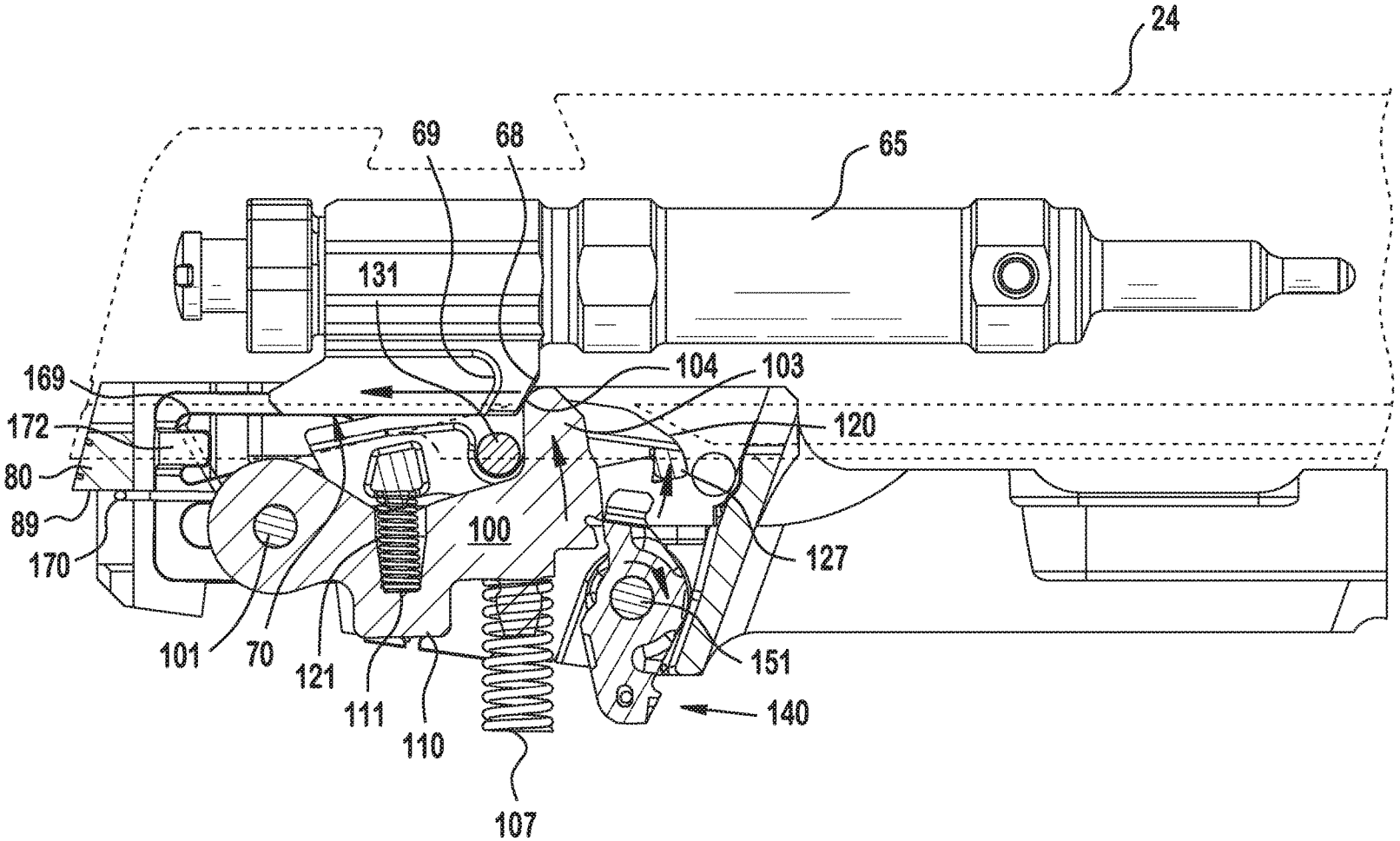
FIG. 14 is a right side view thereof with sear connector actuator removed to reveal the remaining firing mechanism components behind the sear connector actuator.
Figure 29:
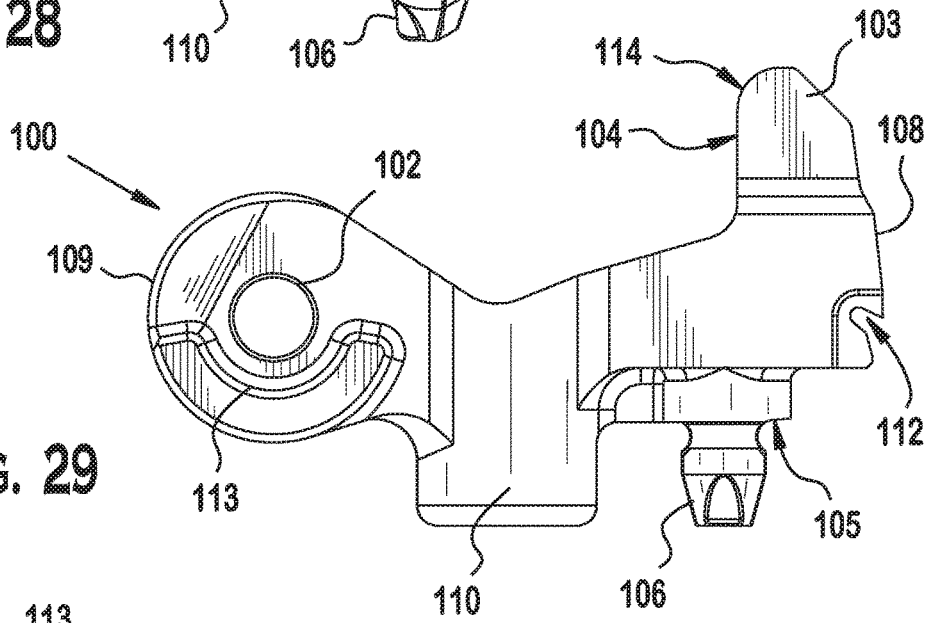
FIG. 29 is a right side view thereof.
Figure 30:
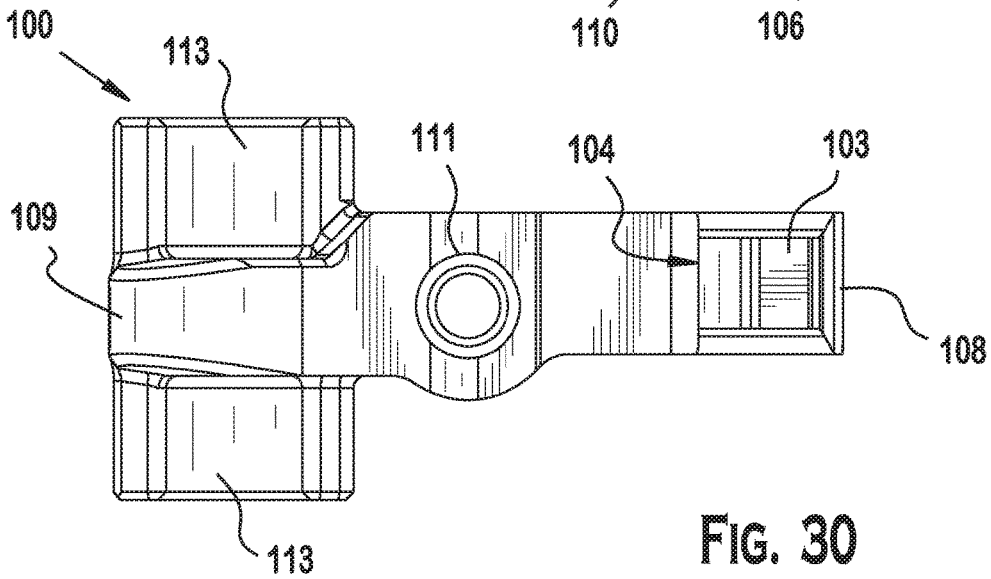
FIG. 30 is a top plan view thereof.
Figure 31:
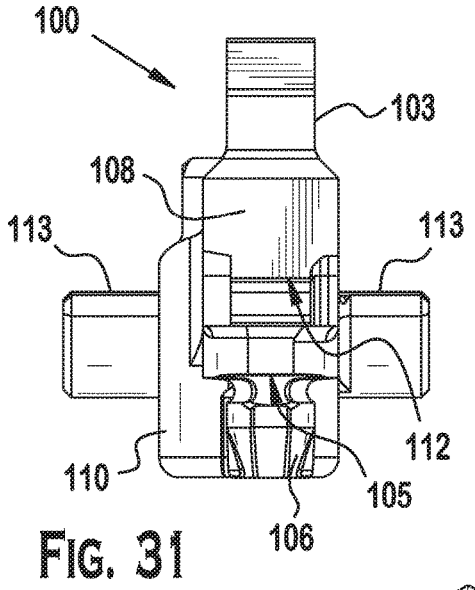
FIG. 31 is a front view thereof.
Figure 32:
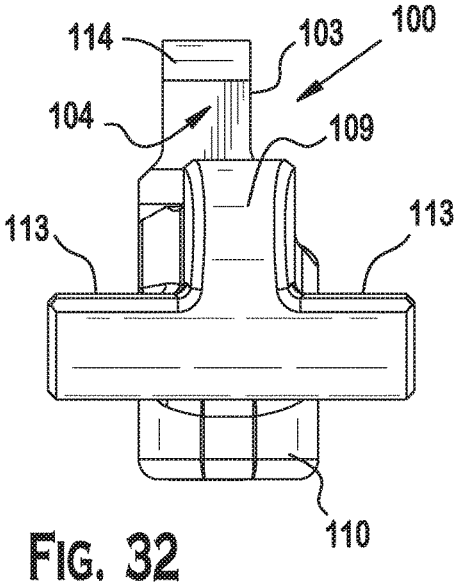
FIG. 32 is a rear view thereof.
Figure 33:
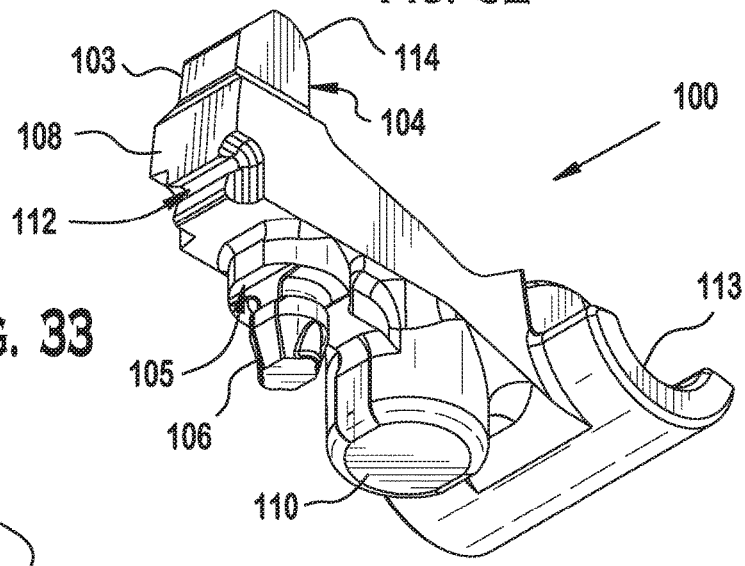
FIG. 33 is a front bottom perspective view thereof.
Figure 34:
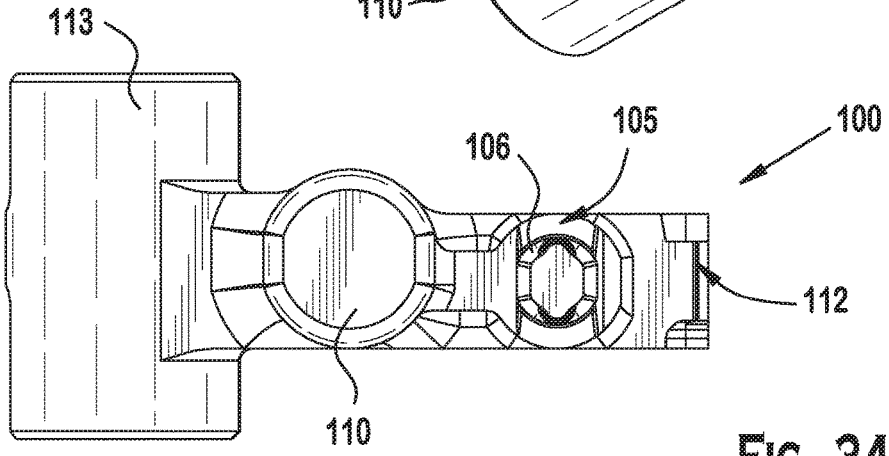
FIG. 34 is a bottom plan view thereof.
Figure 35:
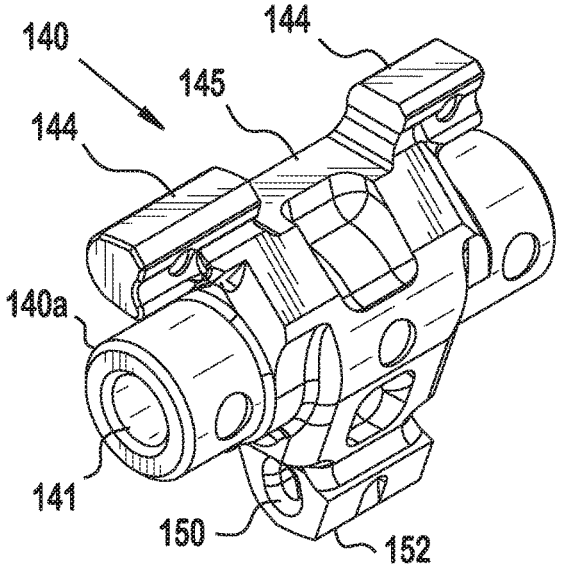
FIG. 35 is a top front perspective view of the sear connector.

Sear connector 140 further includes a horizontally oriented latching surface 145 which is configured and arranged to engage a latching edge 112 formed on a the front end 108 of sear 100 (see also FIGS. 11 and 29). Engagement between the latching surface 145 and edge 112 prevent the sear 100 from moving downwards to release the striker 65. In one embodiment, latching surface 145 may be substantially flat and faces upwards. Latching surface 145 may be disposed between the pair of operating arms 144 in one non-limiting embodiment. In one configuration of sear 100, the latching edge 112 thereon may be formed adjacent a frontal notch formed in a vertical front face of the front end 108 of the sear. In other embodiments, the latching edge 112 may alternatively be formed at an edge between a horizontal bottom surface of sear 100 and the vertical front face.

Sear connector 140 further includes spring 146 which biases latching surface 145 rearward (i.e. counter-clockwise in FIG. 11) towards sear latching edge 112 to positively engage the sear when in the upper engaged position as shown. Any suitable type of spring may be provided. In one non-limiting embodiment, for example, spring 146 may be a torsion spring having a front leg 147 which engages sear connector below mounting pin 142. In one possible configuration, without limitation, leg 147 of spring 146 may engage a lateral hole 150 or slot formed proximate to the bottom 149 of the sear connector 140 below sear connector pin 151 to facilitate positive retention of the leg in the sear connector. In one embodiment, hole 150 may be formed on a protrusion 152 which projects downwardly from tubular portion 140*a* of the sear connector 140. Other configurations and connection arrangements for retaining leg 147 of spring 146 may be used.

Referring to FIGS. 3-11 and 42-49, sear blocker 120 has a body including a pair of laterally spaced apart elongated sides 123*a*, 123*b* oriented axially (i.e. along longitudinal axis LA), front end 121, rear end 122, and lateral cross-piece 124 connecting the two sides together. A longitudinally extending slot 125 having an open top and bottom is formed between sides 123*a*, 123*b* that receives a portion of sear upward catch protrusion 103, thereby permitting engagement with striker catch rail 69.

In one embodiment, front end 121 defines a laterally oriented operating bar 126 which extends horizontally between sides 123*a*, 123*b*. Operating bar 126 may be a continuous structure in one non-limiting embodiment. Other embodiments may have a discontinuous construction. When mounted in the firing control housing insert 80, the operating bar 126 is positioned forward of the sear connector operating arms 144 (see, e.g. FIGS. 9-11).

Front end 121 of sear blocker 120 further defines a downward projecting hooked portion 127 which is configured and arranged to engage at least one operating arm 144 of sear connector 140 for arresting movement of the connector when not intentionally actuated via a trigger pull (e.g. dropping, jarring, or similar of the pistol 20). In one embodiment, hooked portion 127 may be formed on operating bar 126 and includes a rear facing blocking surface 128 that is positioned to engage sear connector 140 and prevent forward pivotable movement of the connector sufficient to release the sear 100 and discharge pistol 20. In the embodiment shown the blocking surface is curved in a manner that if sear connector 140 rotates forward due to jarring of pistol 20 the contact force between surfaces 128 and 143 is directed in a manner that wants to force the blocker 120 and sear connector 140 into more engagement with each other. In certain embodiments, the blocking surface 128 may be flat and/or may be obliquely angled. Blocking surface 128 of sear blocker 120 engages front facing blocking surface 143 of sear connector 120 (see also FIGS. 9-11 and 36).

Figure 9:
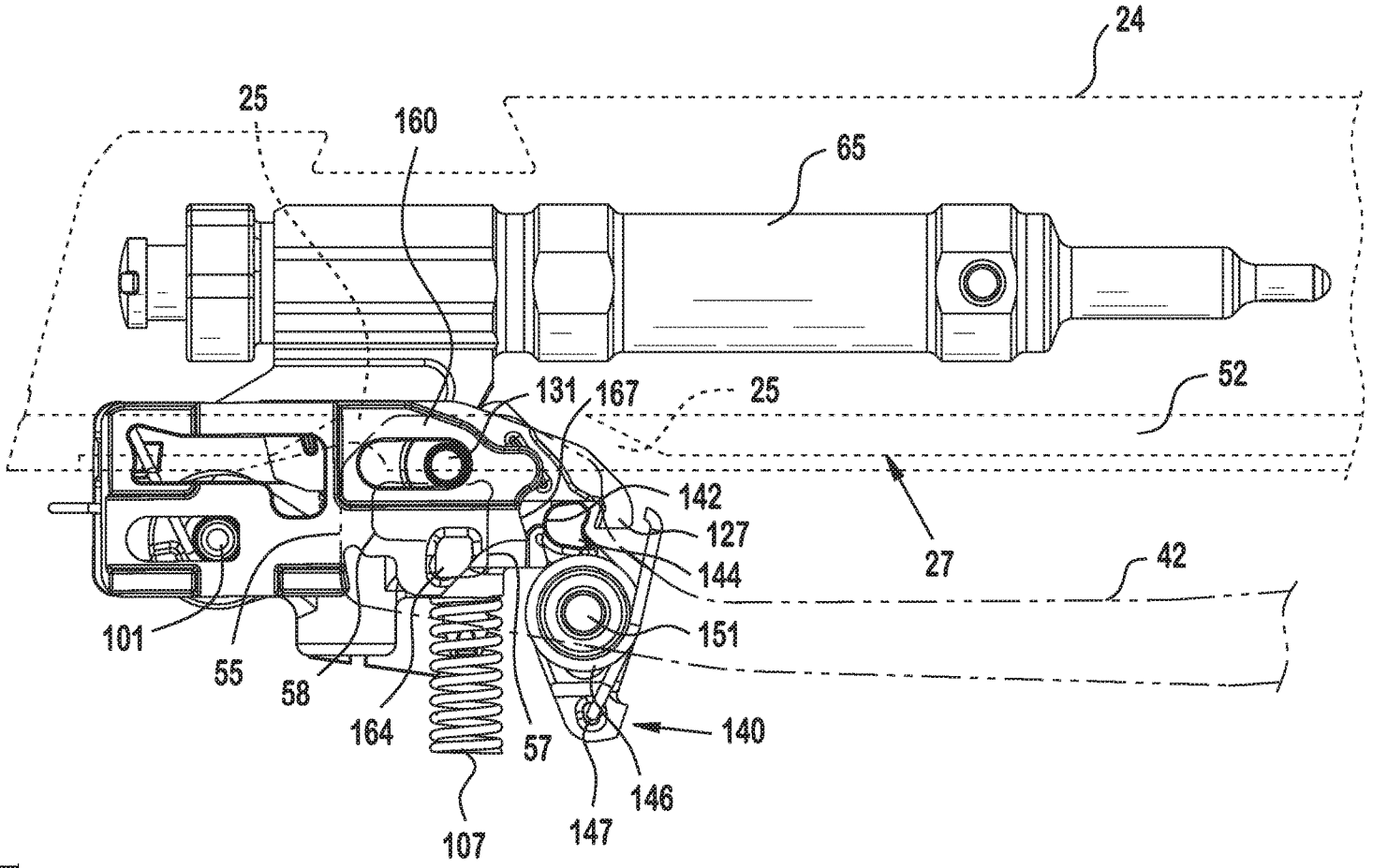
FIG. 9 is a right side view of the striker and the firing mechanism in a first operational position.
Figure 10:
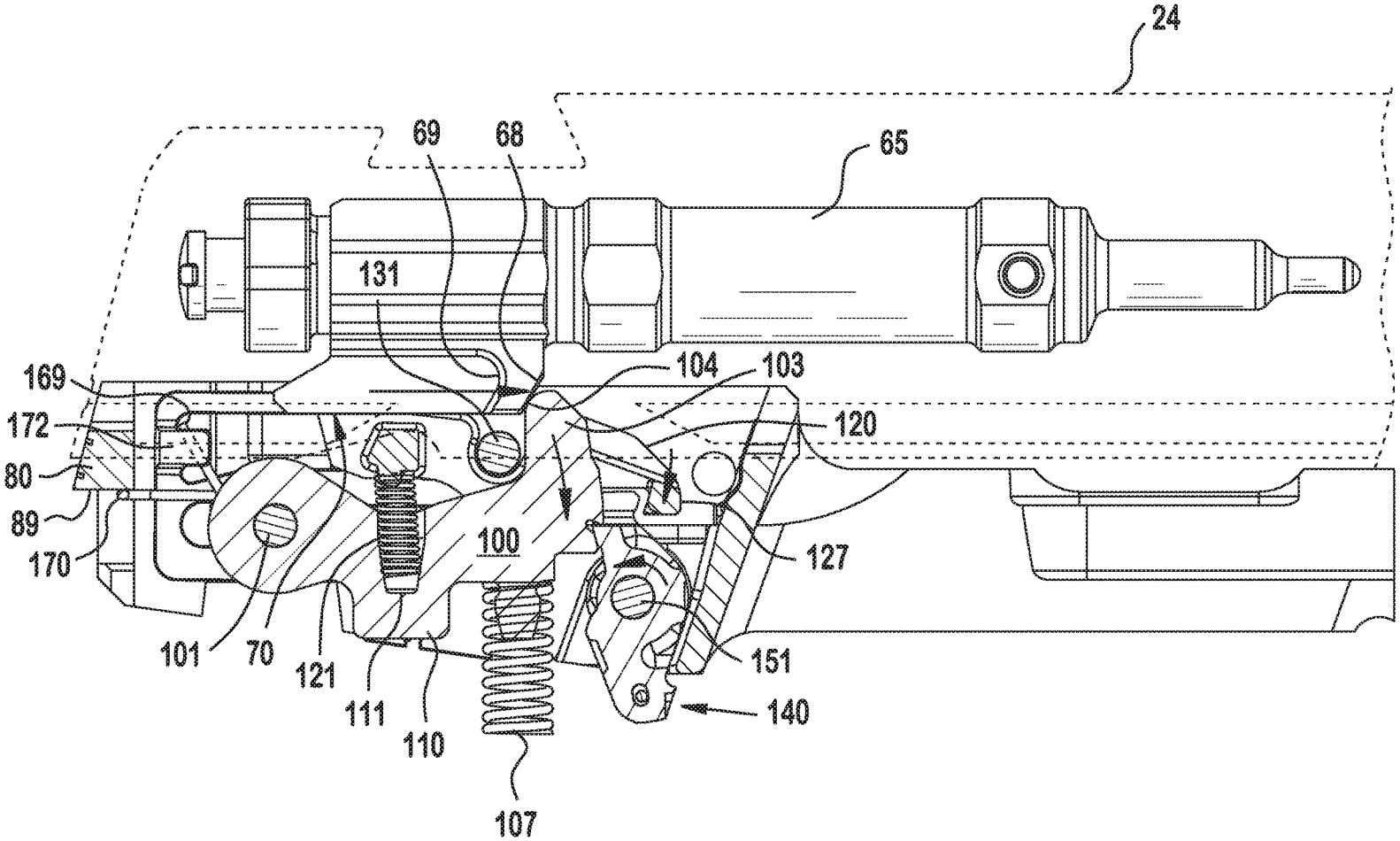
FIG. 10 is a right side view thereof with sear connector actuator removed to reveal the remaining firing mechanism components behind the sear connector actuator.

Sear blocker 120 further includes a rear facing cam surface 129 which engages front facing cam follower surface 162 formed on the front of sear connector actuator 160 for raising the sear blocker to permit release of the sear connector 140 (see also FIGS. 9 and 50). In various embodiments, cam surface 129 may be flat or concavely shaped to engage cam follower surface 162 which may be convexly shaped. In one exemplary embodiment, a laterally spaced apart pair of cam surfaces 129 may be provided. The cam surfaces 129 may be formed on the rear side of lateral protrusions 130 extending outwardly from the main body of the sear blocker 120 (see FIGS. 42-44).

Sear blocker 120 is pivotably mounted to firing control housing insert 80 via a transverse mounting pin 131 which passes through lateral hole 132 formed in the main body of the blocker and defines a pivot axis. Hole 132 may be centrally located at approximately the midpoint between front and rear ends 121, 122 of sear blocker 120. Mounting pin 131 further passes through holes 133 formed in each sidewall 82, 83 of firing control housing insert 80 and longitudinal elongated slots 163 formed in right and left members 160*a*, 160*b* of sear connector actuator 160. This slotted arrangement permits longitudinal linear movement of the actuator with respect to the sear blocker mounting pin 131, firing control housing insert 80, and frame 22 in response to a trigger pull for firing the pistol 20.

Sear blocker 120 may further include a downwardly extending spring mounting post 135 which engages the top end of sear blocker spring 134. The post 135 is disposed rearward of sear blocker pin 131 to bias the rear end 122 of sear blocker 120 upwards and conversely the front end 121 downward. If the sear 100 or sear connector 140 tries to move due to any inertial forces occurring during inadvertent dropping or jarring of pistol 20, spring 134 forces the blocker 120 down harder onto the sear connector to maintain engagement with the sear connector. Advantageously, this prevents release of the sear connector 140 and sear 100 preventing firing of pistol 20 in the absence of an intentional trigger pull, thereby forming a firing safety to prevent discharge of the firearm. Direct engagement of the ends of compression spring 134 with both the sear blocker 120 and sear 100 further promotes this positive interaction to increase the effectiveness of this safety mechanism.

Sear blocker 120 is pivotably movable about sear blocker pin 131 between a substantially horizontal blocking position and a tilted or angled non-blocking position. Sear blocker 120 is biased or urged into the blocking position by sear blocker spring 134. In the blocking position (see, e.g. FIGS. 9-12), hooked portion 127 of sear blocker 120 is located in the forward path of sear connector blocking surface 143 to engage sear connector 140 and arrest its full forward pivoting motion. This prevents the sear connector 140 from rotating a sufficient amount forwarded to release the sear and discharge pistol 20.

In the tilted non-blocking position (see, e.g. FIGS. 13-16), hooked portion 127 of sear blocker 120 is lifted and raised out of the forward path of sear connector blocking surface 143 in response to a trigger pull. This allows the sear connector 140 to rotate forward to raise the sear and actually move the striker 65 back slightly. This positive engagement will want to reset the sear connector to its rearward resting position against the sear.

Referring to FIGS. 3-11 and 50-61, sear connector actuator 160 includes laterally spaced apart right and left members 160*a*, 160*b*. Each member is axially elongated and generally comprises a flat plate-like body having a vertical orientation. Right and left members 160*a*, 160*b* each include a front end 165 and rear end 166.

Right member 160*a* includes a laterally extending actuating post 164 configured and arranged to engage the trigger bar 42 for slideably moving the actuator 160 forward in firing control housing insert 80. Actuating post 164 may be disposed proximate to the bottom front end 165 of the right member 160*a*. In one embodiment, actuating post 164 projects transversely outward away from longitudinal axis LA and through an elongated longitudinal opening or slot 88 in sidewall 82 of firing control housing insert 80 to engage the trigger bar 42 which may be mounted in frame 22 laterally adjacent and external to the firing control housing insert in some configurations (see, e.g. FIG. 3—firing control housing insert not shown in this figure). This slotted arrangement allows linear movement of the post 164 and right member 160*a* with respect to the firing control housing insert 80 in response to a trigger pull. Trigger bar 42 actuates and moves the sear connector actuator 160 via a trigger pull, as further described herein.

Figure 36:
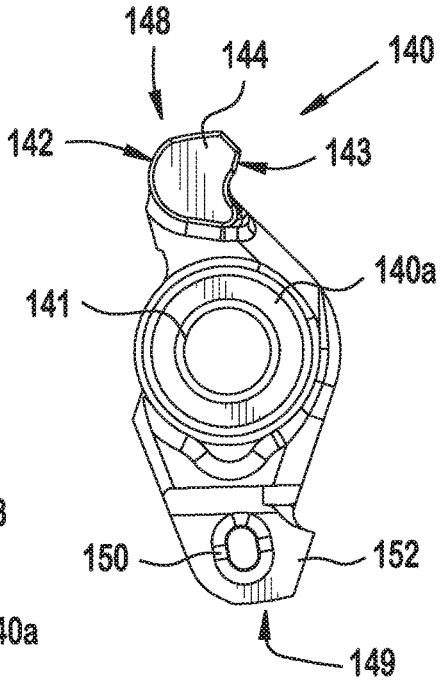
FIG. 36 is a right side view thereof.
Figure 37:
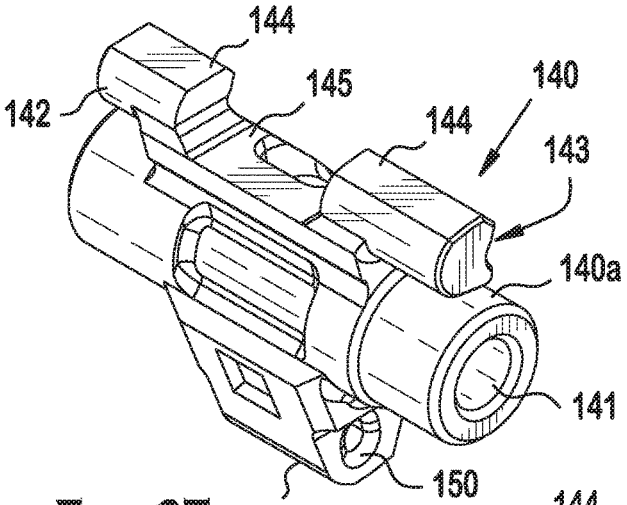
FIG. 37 is a top rear perspective view thereof.
Figure 38:
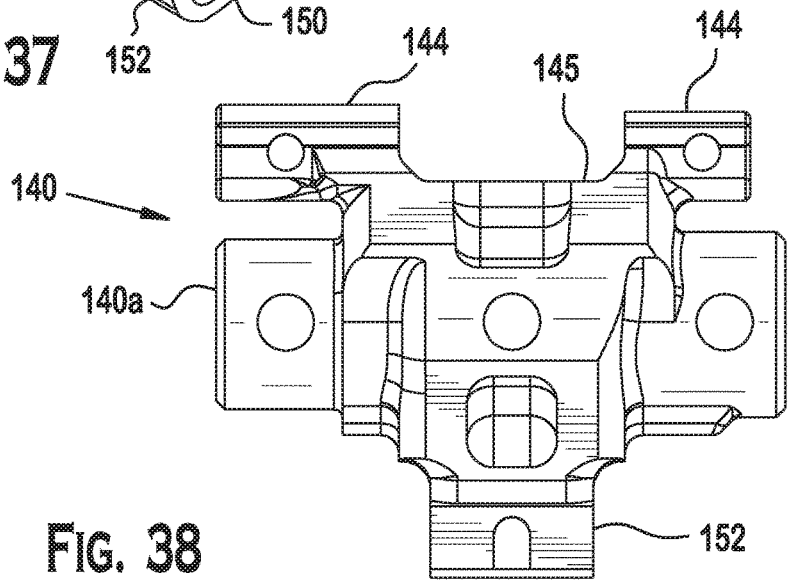
FIG. 38 is front view thereof.
Figure 39:
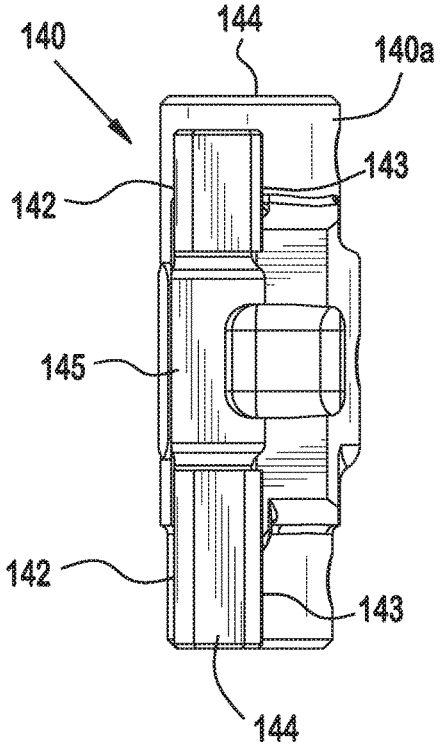
FIG. 39 is a top plan view thereof.
Figure 40:
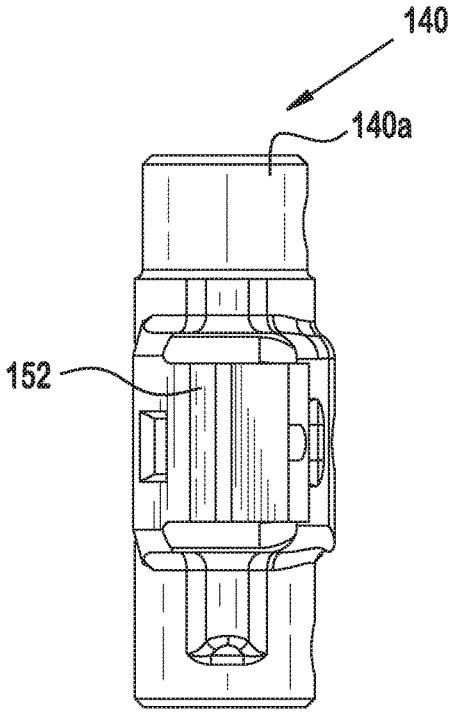
FIG. 40 is a bottom plan view thereof.
Figure 41:
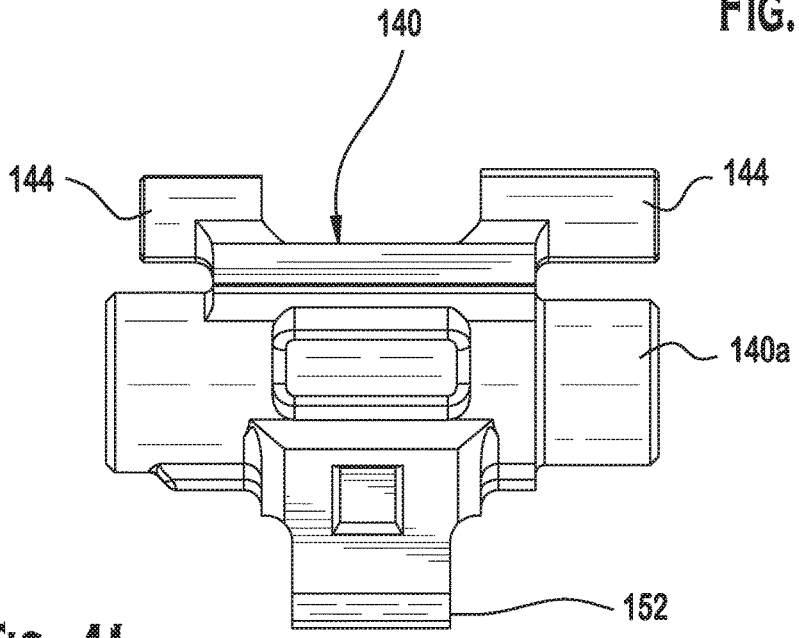
FIG. 41 is a ear view thereof.
Figure 46:
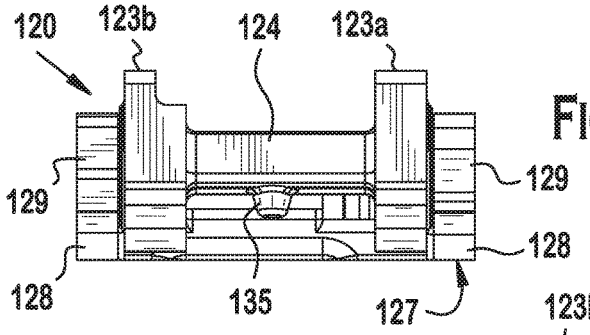
FIG. 46 is a rear view thereof.
Figure 47:
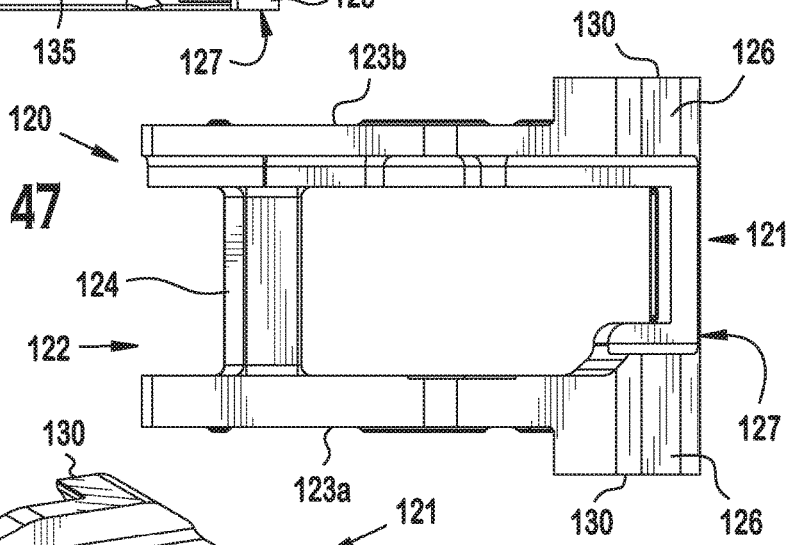
FIG. 47 is a top plan view thereof.
Figure 48:
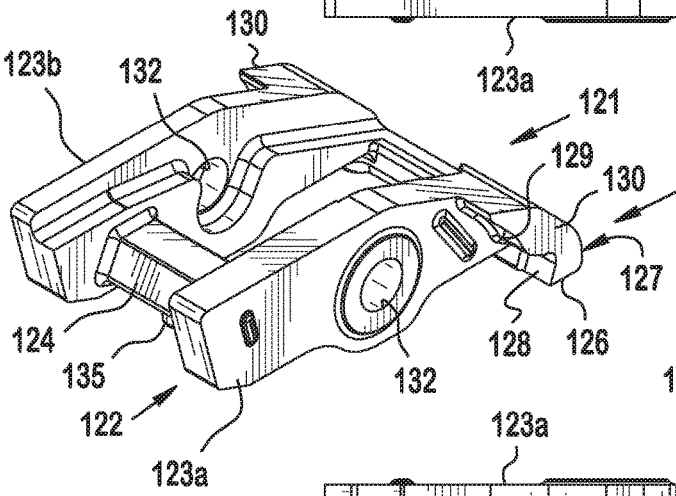
FIG. 48 is a top rear perspective view thereof.
Figure 49:
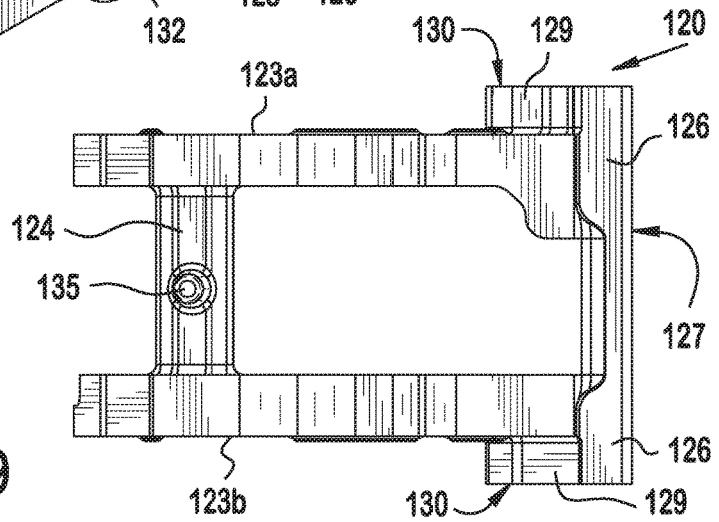
FIG. 49 is a bottom plan view thereof.
Figure 54:
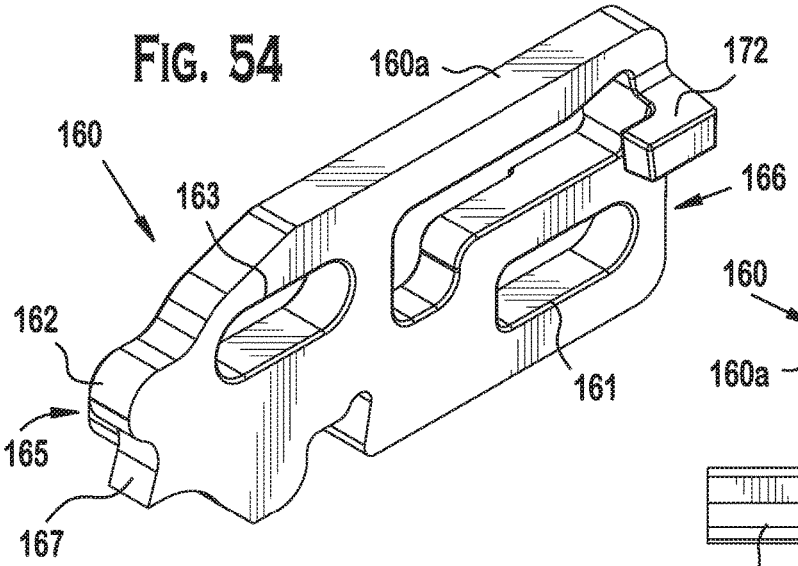
FIG. 54 is a front left perspective view thereof.
Figure 55:
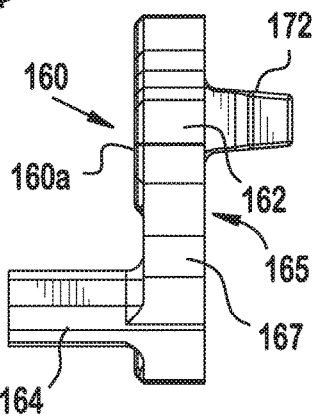
FIG. 55 is a front view thereof.
Figure 56:
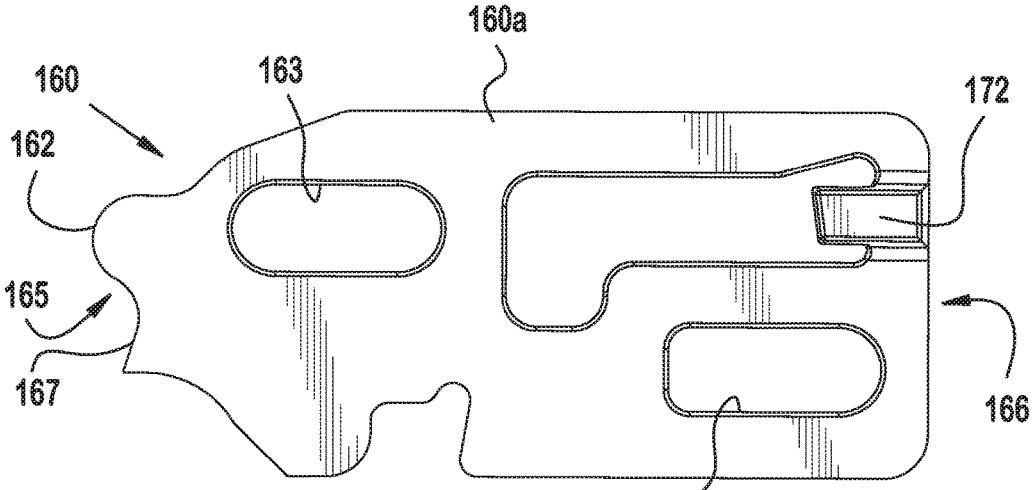
FIG. 56 is a left side view thereof.
Figure 57:
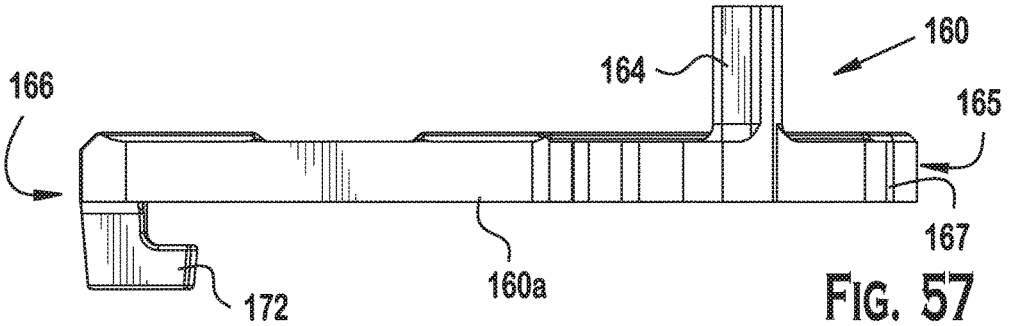
FIG. 57 is a bottom plan view thereof.
Figure 58:
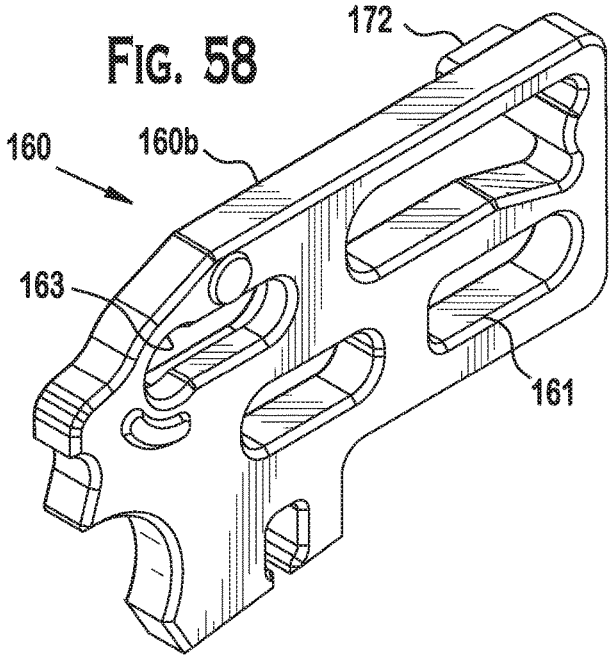
FIG. 58 is a front left perspective view of a left member of the sear connector actuator.
Figure 59:
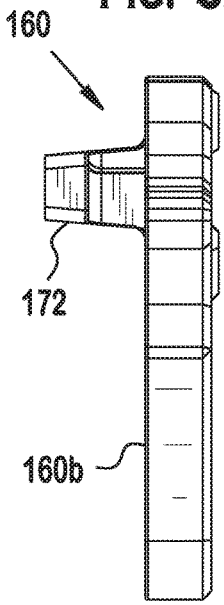
FIG. 59 is a front view thereof.
Figure 60:
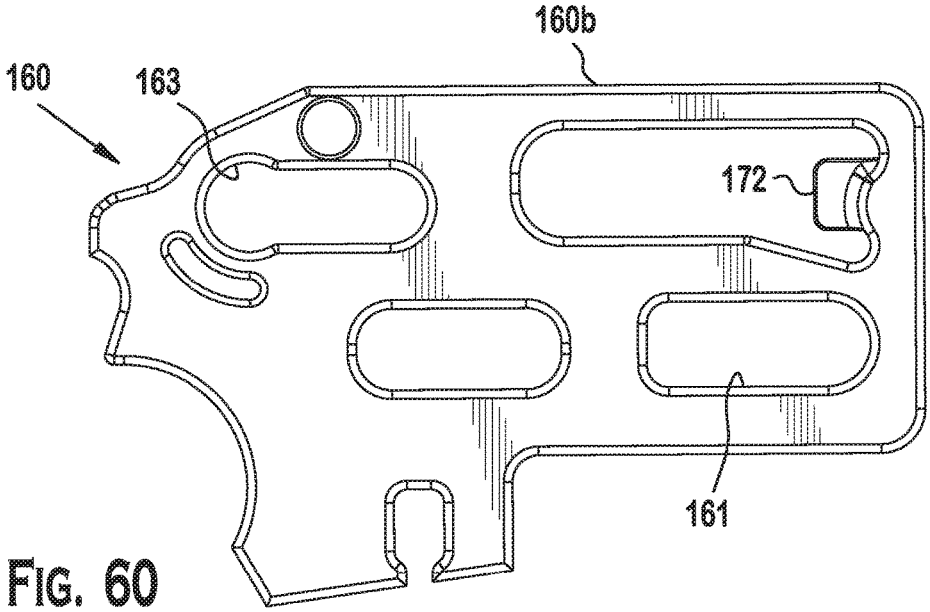
FIG. 60 is a left side view thereof.
Figure 61:
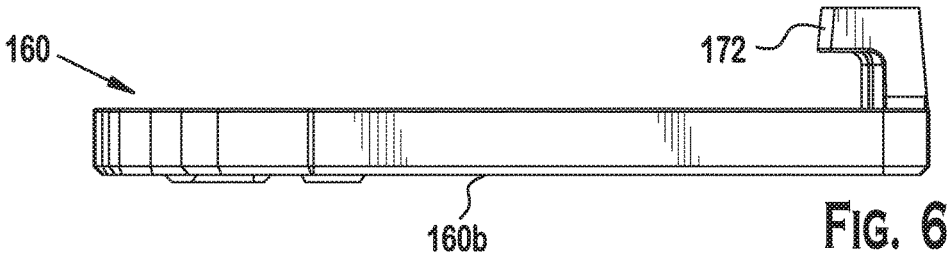
FIG. 61 is a top plan view thereof.
Figure 63:
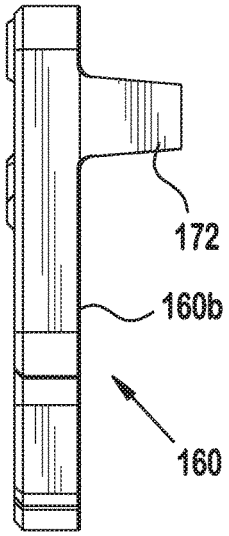
FIG. 63 is a rear view thereof.
Figure 62:
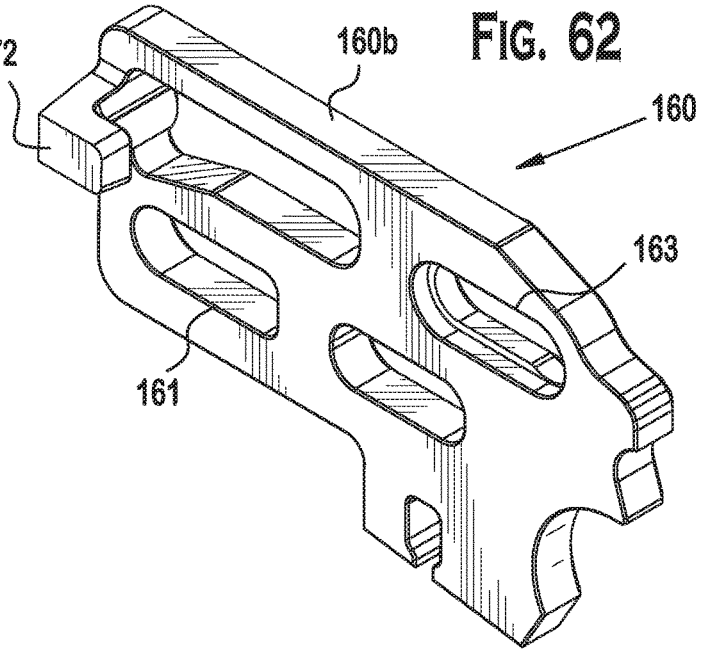
FIG. 62 is a front right perspective view thereof.
Figure 64:
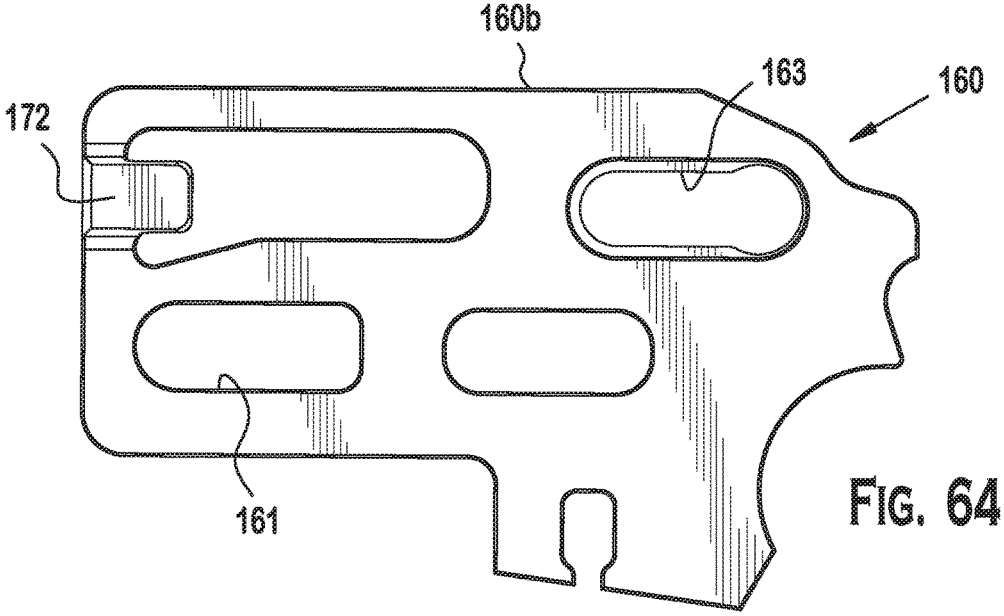
FIG. 64 is a right side view thereof.
Figure 65:
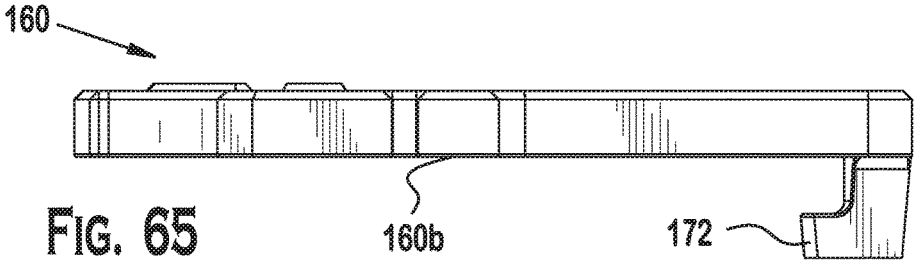
FIG. 65 is a bottom plan view thereof.

Right and left members 160*a*, 160*b* of sear connector actuator 160 each further include cam follower surface 162 which engages rear facing cam surface 129 of sear blocker 120 and a cam surface 167 which engages rear facing cam follower surface 142 of sear connector 140 (see also FIG. 36). In one embodiment, cam follower surface 162 and cam surface 167 may be formed on the front ends 165 of the right and left members 160*a*, 160*b*.

In one embodiment, the right and left members 160*a*, 160*b* of sear connector actuator 160 are movable independently of each other. Accordingly, the right and left members may not be physically connected to each other in a manner in which movement of one member would cause movement of the other. Therefore, actuation of the right member 160*a* via a trigger pull does not actuate or move the left member 160*b* in this embodiment. Left member 160*b* is a takedown actuator associated with the pistol takedown system used to disassemble the pistol. The takedown system comprises an axially movable and elongated takedown lever or link 200 coupled to a transverse takedown pin 202 and operating lever 201 assembly which are rotatably mounted to the pistol frame 22 (see, e.g. FIGS. 3 and 4). Link 200 has an inwardly hooked rear end 203 which engages a downwardly open slot 204 formed in the bottom surface of left member 160*b*. Rotating the takedown pin 202 via lever 201 90 degrees in a clockwise direction in FIG. 4 moves the link 200 axially forward towards the muzzle end of the barrel. An eccentric cam 300 on the takedown pin engages a cam surface 302 on the front end of takedown link which turns the rotary motion into linear travel of the link 200. As the takedown link translates forward it pulls and linearly translates the left member 160*b* (i.e. takedown actuator plate) forward as well. Movement of left member 160*b* rotates sear blocker 120 up out of the way via a cam angle on the sear blocker. This movement also pushes on the sear connector 140, rotating the sear connector forward and allowing the sear 100 to drop out of the way of the striker 65 so that the slide 24 can be removed from the frame 22.

A sear connector actuator spring 168 biases the right and left members 160*a*, 160*b* of sear connector actuator 160 rearwards, thereby requiring a trigger pull for axially moving trigger bar 42 forward which is turn actuates and moves the right member 160*a* forward for firing the pistol 20. Spring 168 in one exemplary embodiment may be a torsion spring including a pair of legs 169 and central loop 170 arranged to engage lateral slot 89 of firing control housing insert 80 (see, e.g. FIGS. 5 and 6). Legs 169 each engage an L-shaped hook 172 formed on the inner surface of right and left members 160*a*, 160*b* of sear connector actuator 160. The action of the spring legs 169 on the hooks 172 biases the right and left members 160*a*, 160*b* rearward.

Sear connector actuator spring 168 may be mounted on sear pin 101 in one arrangement and includes a pair of spaced apart coiled sections 171 which fall on either lateral side of the sear 100. This conserves room within the firing control housing insert 80 and provides a spatially efficient arrangement. In one configuration, the sear 100 may include a pair of arcuate spring seats 113 configured for receiving coiled sections 171.

Referring now to FIGS. 3, 9, and 26-27, trigger bar 42 may be a generally flat and relatively thin plate-like structure having an elongated configuration and vertical orientation. In one embodiment, trigger bar 42 may include a bulbous rear end 55 which enlarged in height with respect to narrower forward portions and the front end 56 of the trigger bar. Rear end 55 defines an axially elongated operating window 67 configured to receive and engage actuating post 164 of sear connector actuator 160 therein. Forward longitudinally movement of the trigger bar 42 via a trigger pull concomitantly pulls the sear connector actuator 160 linearly forward to enable the firing mechanism. In one embodiment, operating window 67 may be generally L-shaped in configuration rotated 90 degrees counter-clockwise, as shown. Operating window 67 includes a longitudinally elongated slot portion 58 and a notched portion 57 extending downwards therefrom and in communication with portion 58. Notched portion 57 may have an axial length shorter than slot portion 58 and slightly larger than actuator post 164 to eliminate excessive play of the post within the notched portion when pulling the trigger 40. This creates positive engagement of the trigger bar 42 with the actuating post 164.

It will be appreciated that operating window 67 further interacts with actuating post 164 of sear connector actuator 160 to provide a vertical stop for limiting the upward position of trigger bar 42 under the biasing force of trigger spring 44 via the bottom surfaces of slot portion 58 and notched portion 57 of window 67 engaging the post 164

(depending on which portion the post happens to be positioned in). Other configurations of operating window 67 and trigger bar 42 are possible so long as the trigger bar functions to actuate the sear connector actuator 160 via a trigger pull.

Operation of the firing control and blocker mechanism will now be described. In one embodiment, the trigger mechanism may be a two-stage trigger as further described below with varying trigger pull forces in each stage.

Starting with pistol 20 in the ready-to-fire position shown in FIGS. 9-12, striker 65 is shown cocked rearwards in a ready-to-fire position. Sear bearing surface 68 on striker catch rail 69 is in axial alignment and engaged with striker catch surface 104 on sear 100, thereby holding the striker 65 rearward against the forward biasing force of striker spring 64. Sear connector blocker 120 is in the activated horizontal blocking position wherein rear facing blocking surface 125 on the hooked portion 127 of the blocker is axially aligned with and positioned to engage front facing blocking surface 143 on the sear connector 140 if the sear connector attempts to rotate forward to release the sear 100 and striker 65 somehow in the absence of a trigger pull. Trigger bar 42 is in its rearmost axial position with actuating post 164 of sear connector actuator 160 shown engaged in notched portion 57 of operating window 67. The trigger bar is in a spring-biased upward position (see, e.g. FIG. 27) with the top portion of bulbous rear end 55 seated in pocket 25 on the right side of the slide 24.

FIGS. 13-16 show the firing control and blocking mechanism after a trigger pull has been initiated by a user. Pulling trigger 40 rearward rotates trigger pivot extension 46 (containing transverse pin 43 linking the trigger bar 42 to trigger) forward, thereby simultaneously pulling the trigger bar axially forward therewith. As trigger bar 42 moves forward, it pulls sear connector actuator 160 via actuating post 164 positioned in notched portion 57 of trigger bar operating window 67 correspondingly forward in a linear axial movement. Cam follower surface 162 on the front of the actuator 160 soon engages rear facing cam surface 129 of sear blocker 120, which has a generally angled and oblique orientation with respect to the longitudinal axis LA (axial direction) sloping downwards from rear to front. This mutual engagement raises front end 121 of sear blocker 120 upwards pivoting and titling the sear blocker rearwards (counter-clockwise in these figures) about pin 131 against the biasing force of and compressing spring 134. The sear blocker 120 thus moves to the non-blocking position, in which rear facing blocking surface 125 on the hooked portion 127 of the blocker is moved above and no longer axially aligned with and positioned to engage front facing blocking surface 143 on the sear connector 140. The blocker safety mechanism is now disabled. Continued pulling of the trigger 40 causes the actuator cam follower surface 162 to maintain contact with and slide downwards along sear blocker cam surface 129.

Figure 15:
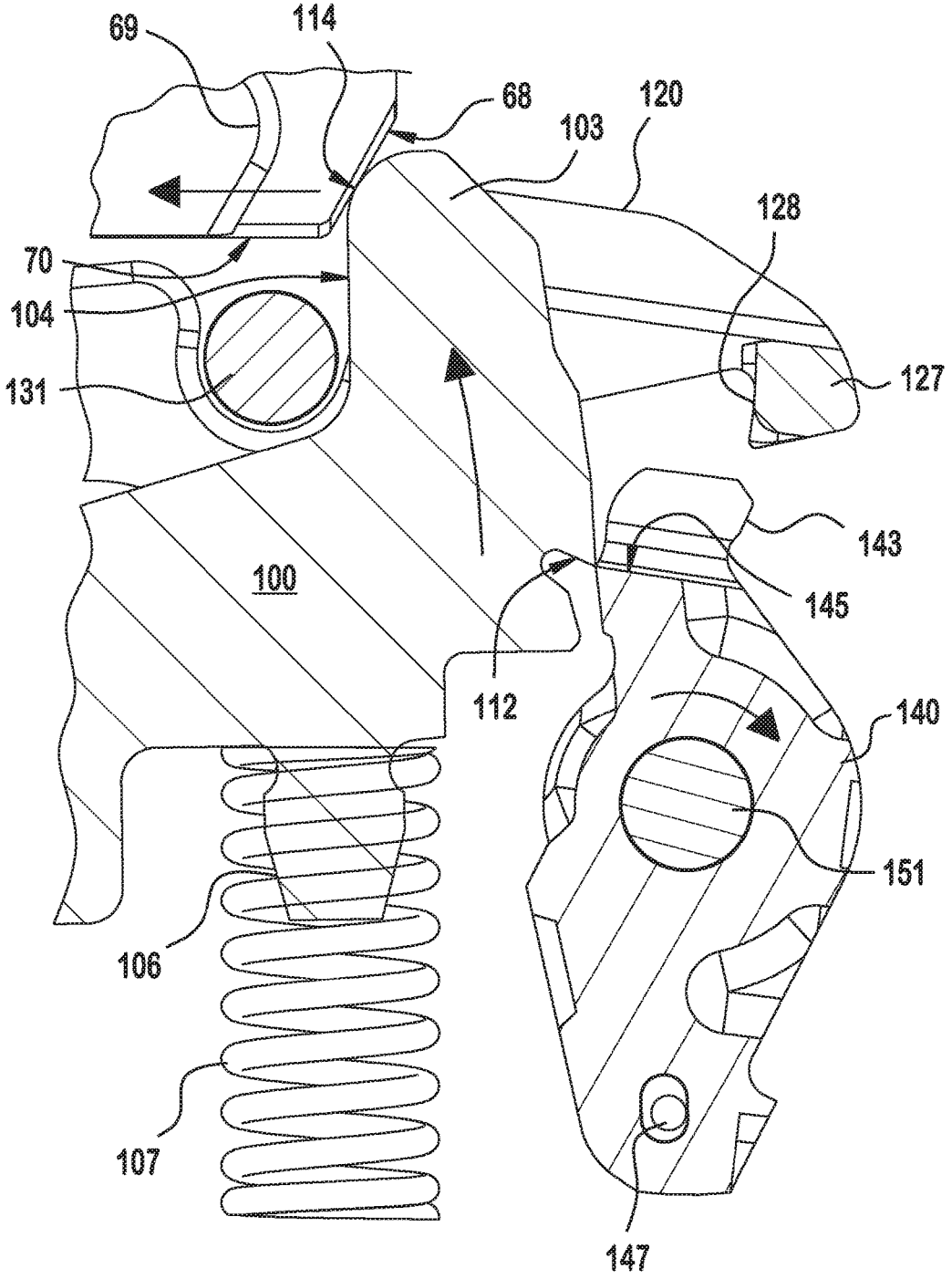
FIG. 15 is a detailed partial view thereof showing firing mechanism components in the second position.
Figure 16:
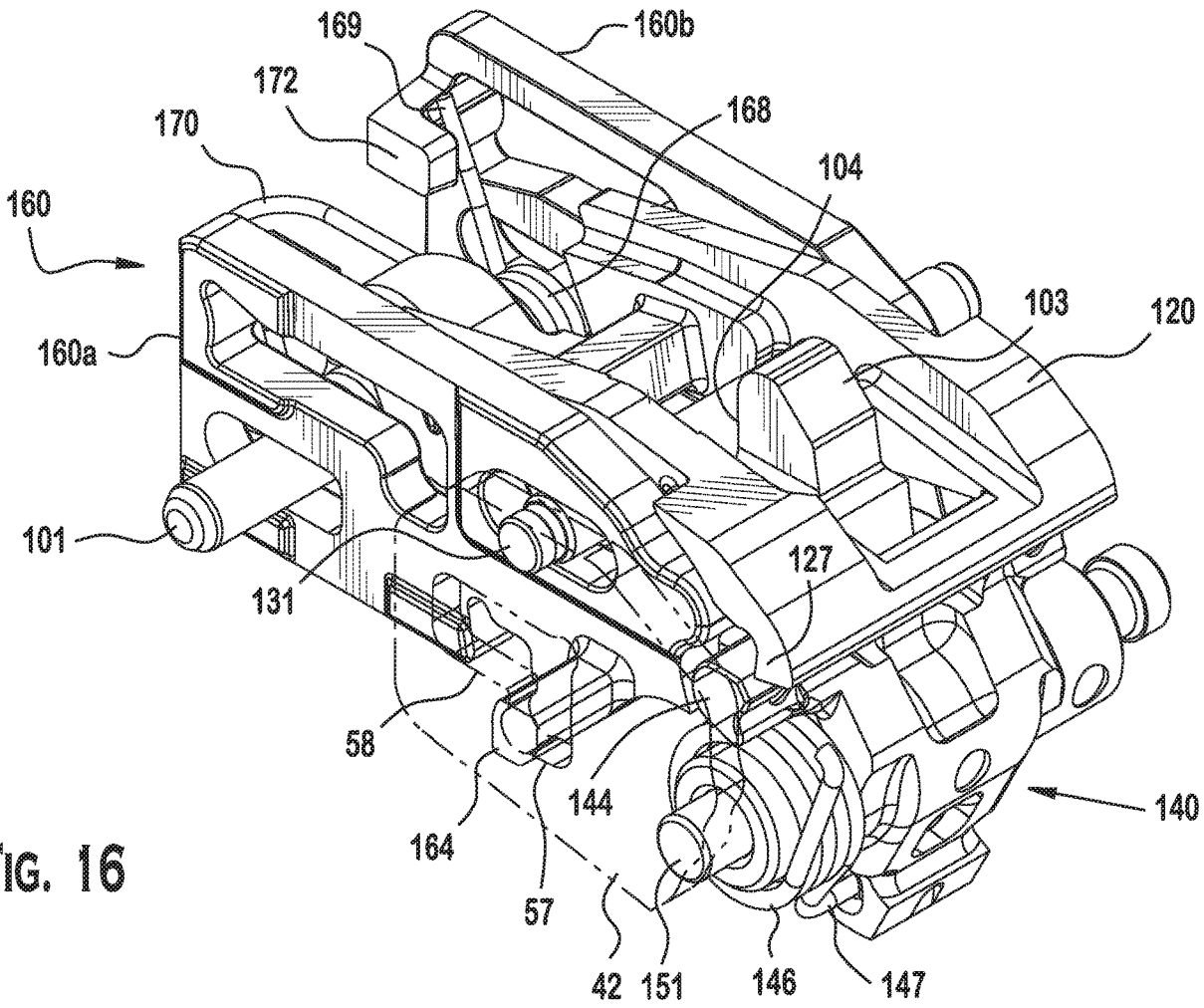
FIG. 16 is a front top perspective view thereof showing the entire firing mechanism.
Figure 17:
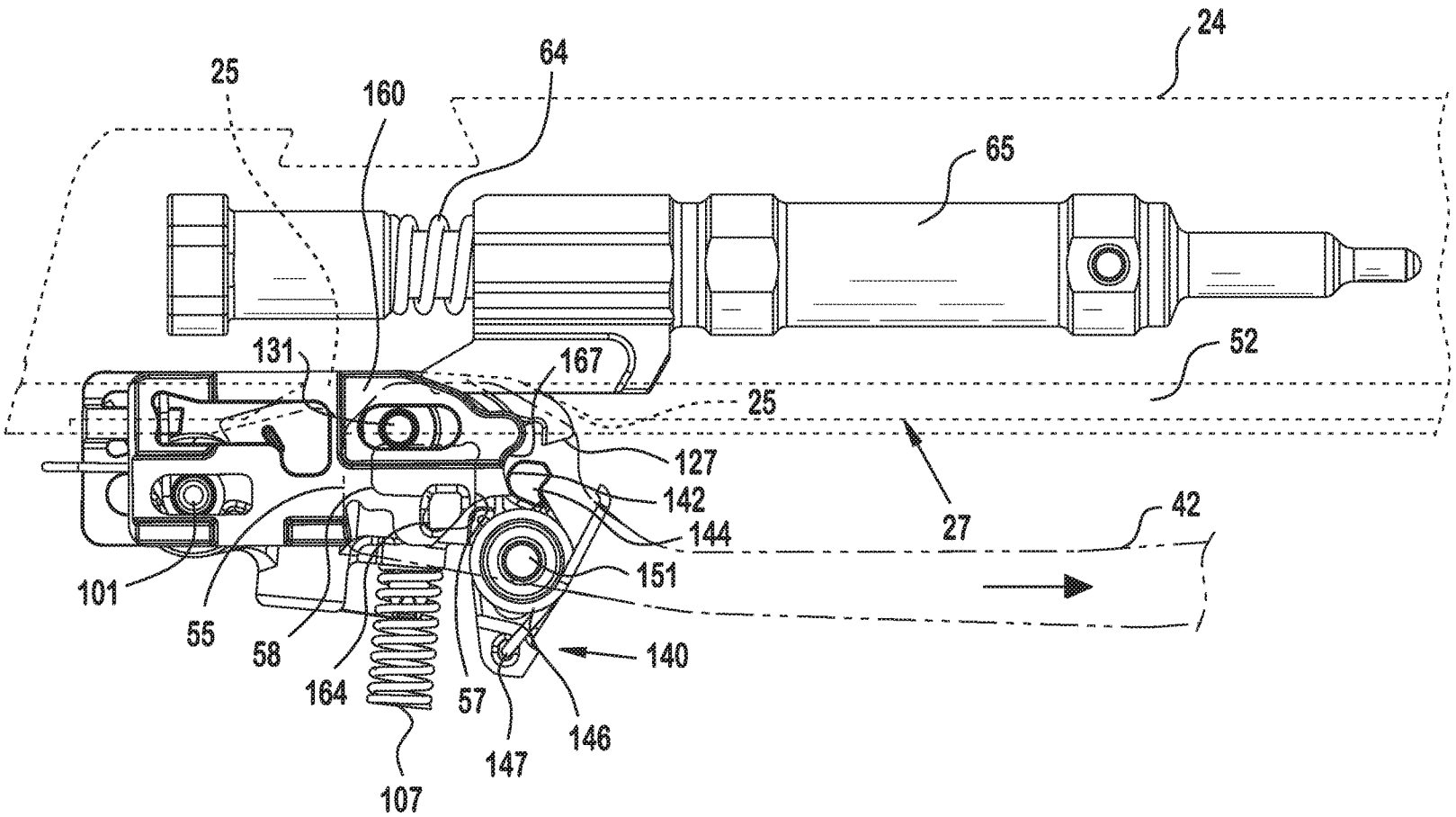
FIG. 17 is a right side view of the striker and the firing mechanism in a third operational position.
Figure 66:
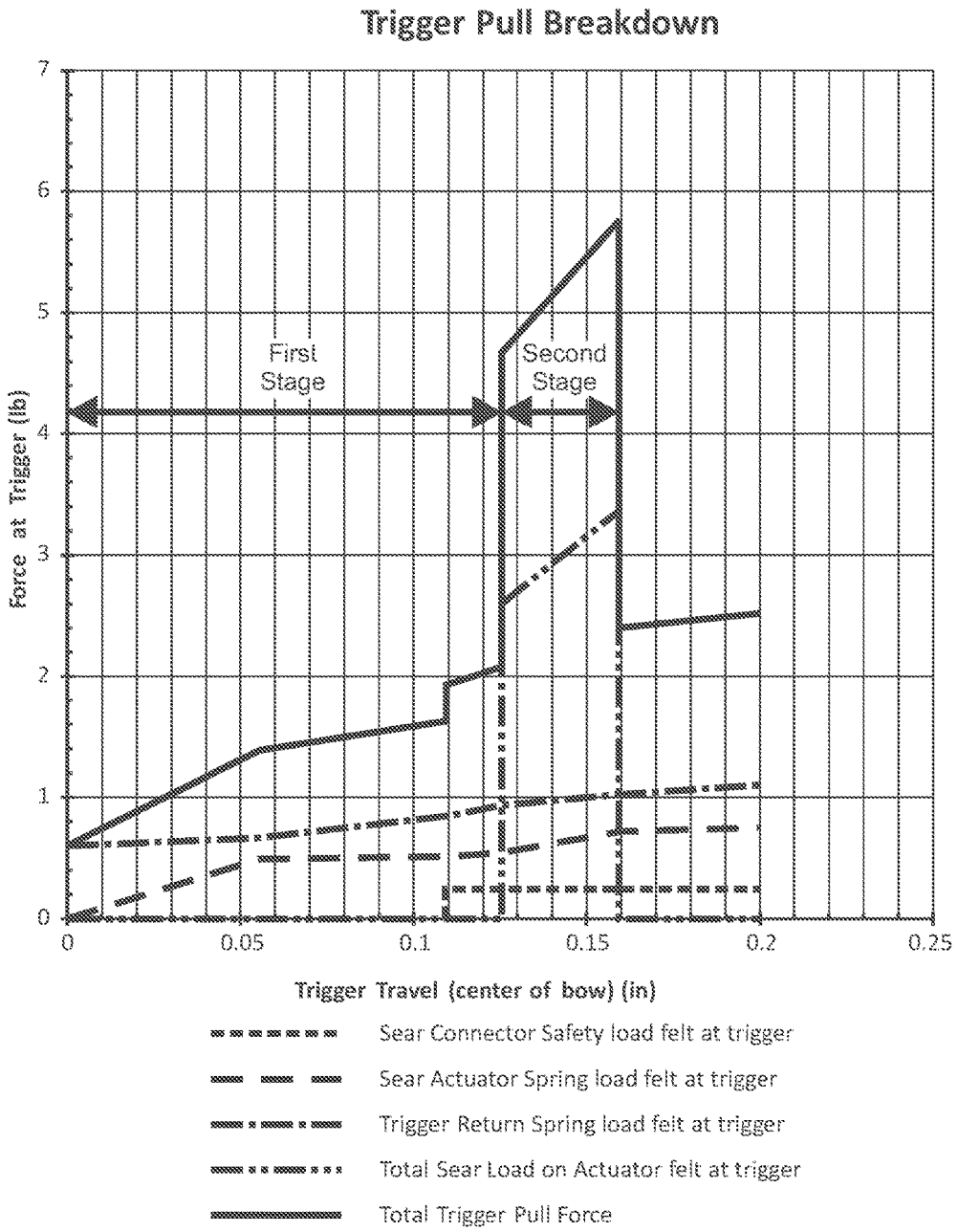
FIG. 66 is a chart depicting the trigger pull force breakdown of a two-stage trigger pull system of the presenting firing control system.

With continued reference to FIGS. 13-16, cam surface 167 of sear connector actuator 160 continues to be pulled forward by trigger bar 42 with the trigger pull and eventually engages rear facing cam follower surface 142 of sear connector 140. In one embodiment, this occurs immediately after sear blocker 120 has been moved to the non-blocking position by sear connector actuator 160 (described above), which now will further act to rotate and actuate the sear connector 140 while simultaneously holding the sear blocker in the non-blocking position. As trigger 40 continues to be pulled rearward, the sear connector actuator 160 moves axially forward continuing to rotate the sear blocker 120 up and forward out of the way. Sear connector actuator 160 is now rotating the sear connector 140 forward and downward out from under the sear 100, thereby further tensioning sear connector spring 146. The sear 100 rises slightly during this motion to push back the striker 65 slightly as the sear connector 140 rotates which is caused by engagement between sear connector latching surface 145 and sear latching edge 112 as shown in FIG. 15 (see directional arrows). This further compresses the striker spring 64 providing the heavier second stage trigger load which is felt by the user as increased resistance at the trigger 40 transmitted via the firing control and trigger linkage (see, e.g. FIG. 66 showing first and second trigger pull stages and forces). FIG. 15 shows the sear connector 140 and sear 100 at the takeoff point immediately before engagement between these components is broken to fire the pistol 20 (note position of latching edge 112 on edge of latching surface 145).

FIGS. 17-20 show the firing mechanism in the action of firing pistol 20 and the striker 65 is released forward to strike a chambered cartridge. Sear connector actuator 160 continues to push and rotate the sear connector 140 forward and downward to break contact between the sear connector and sear 100 as shown. Without support from sear connector 140, sear 100 now rotates forward and downward under the forward biasing force of striker spring 64 and contact between sear bearing surface 68 of striker 65 and striker catch surface 104 (i.e. convex camming portion 114) of sear 100 is broken, as described elsewhere herein. Sear spring 107 is compressed downwards in the process. Striker 65 is thus released from the sear 100 and travels axially forward rapidly to strike and detonate a chambered cartridge C, thereby discharging the pistol 20. Striker catch surface 104 on upward catch protrusion 103 of sear 100 slides from angled sear bearing surface 68 on striker 65 down onto cam track 70 on the bottom surface of the striker catch rail 69. The sear striker catch surface 104 maintains contact with and slides rearwards along cam track 70 which acts to hold the sear 100 in the downward position as the striker 65 moves forward. The striker catch rail 69 defining cam track 70 thereon has a sufficient axial length to hold the sear 100 down at least until the striker reaches and strikes the chambered cartridge.

After pistol 20 has been discharged, the slide 24 travels rearward under recoil to a point where catch rail 69 of striker 65 (mounted in the slide) breaks contact with the sear 100 (see, e.g. FIGS. 21-24). The sear 100 now is free to rotate upward and rearward under expansion of the sear spring 107 thereby returning the sear to its former upright position. The sear 100 upward rotation is stopped by contact with the sear blocker pivot pin 131. Once sear 100 rotates up, the sear connector 140 is also able to rotate back under and engage sear latching edge 112 due to relaxation of sear connector spring 146. Once sear connector 140 is back against and re-engages sear 100, sear blocker 120 is able to rotate back down to the blocking position as sear blocker spring 134 expands and resets itself to prevent sear connector rotation. Sear bearing surface 68 of striker 65 reengages striker catch surface 104 of sear 100. The striker firing mechanism is now re-cocked and reset as shown. In one embodiment the sear spring 107 may typically have a higher force than the blocker spring 134 although in some embodiments spring 134 could be stronger in theory, but in practice it is not needed. This is where the uniqueness of the present invention comes into play. The sear in its upmost position (against sear blocker pivot pin 131) is going to compress blocker spring 134 due to the arrangement where one end of spring 134 rests in the pocket of the sear. So the upward motion of the sear is always going to compress spring 134 and increase the force on the back of the blocker, which is going to want to force it down into its blocking position. So if the pistol is dropped in a manner that wants the sear to move up against sear blocker pin 131 due to inertial effects (noting that the sear is not balanced), the effect would be to force the blocker 120 down against sear connector actuator 160*a* with more force, thereby keeping 160*a* from being able to rotate out from under and releasing the sear.

Figure 21:
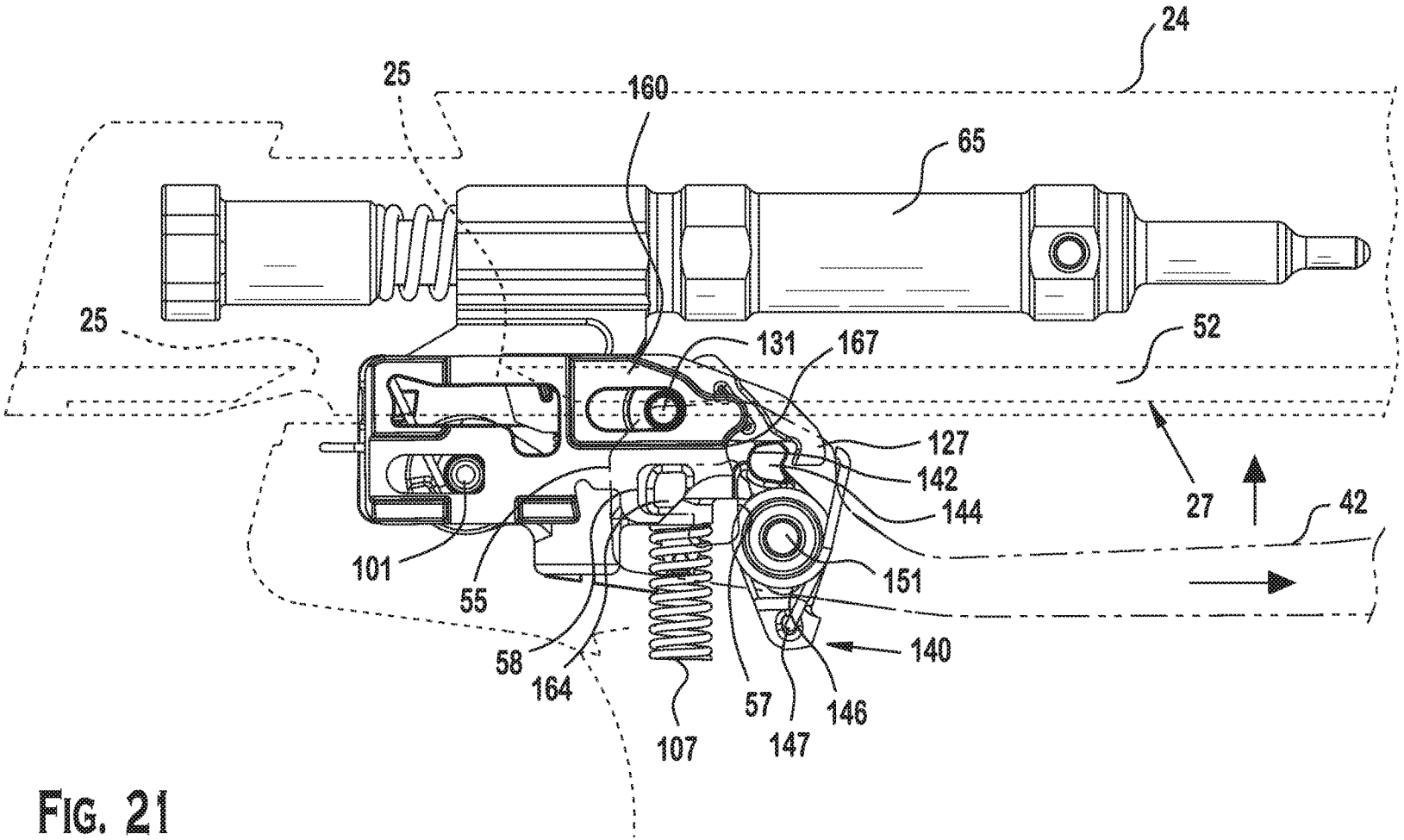
FIG. 21 is a right side view of the striker and the firing mechanism in a fourth operational position.
Figure 22:
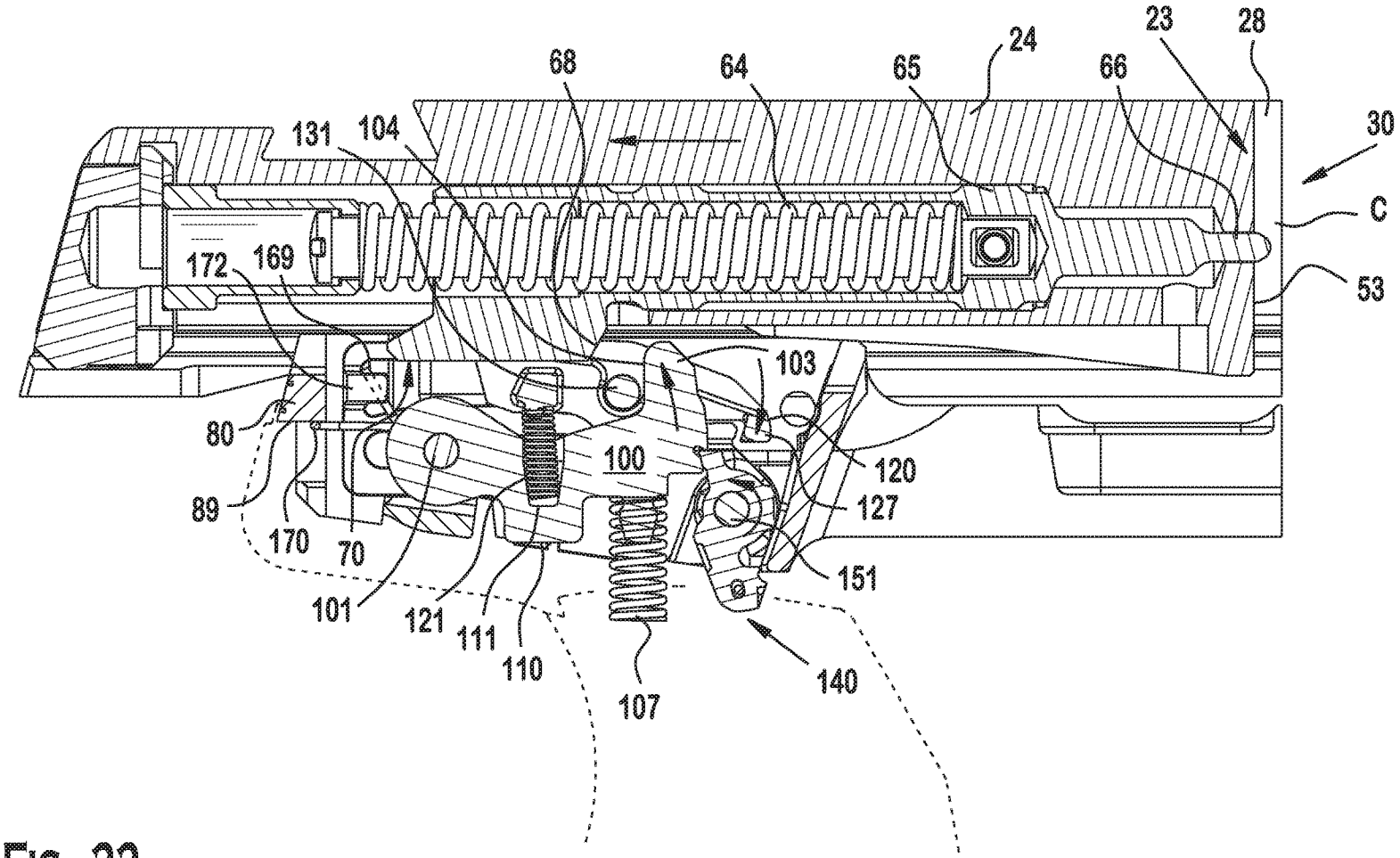
FIG. 22 is a right side view thereof with sear connector actuator removed to reveal the remaining firing mechanism components behind the sear connector actuator.
Figure 23:
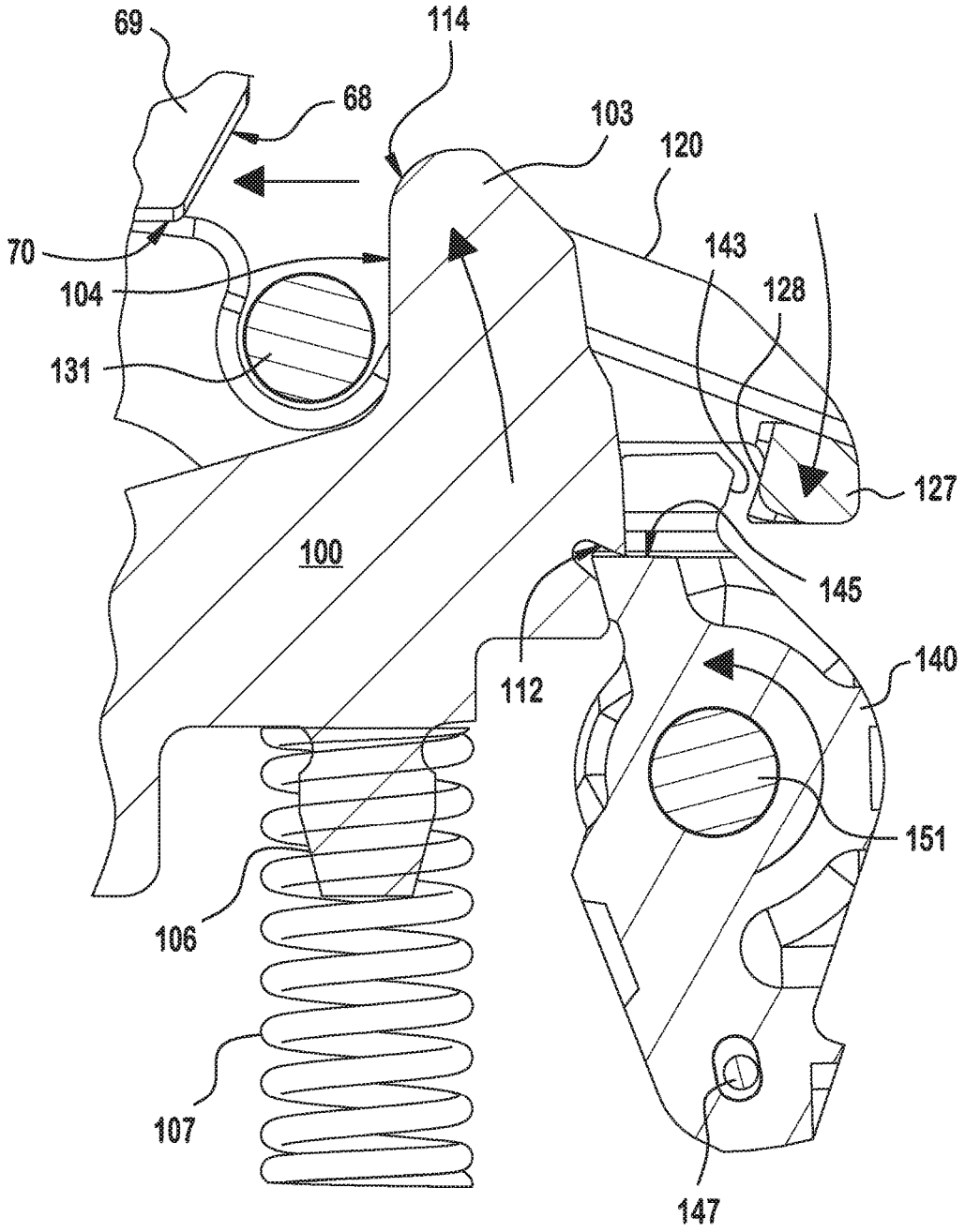
FIG. 23 is a detailed partial view thereof showing firing mechanism components in the fourth position.
Figure 24:
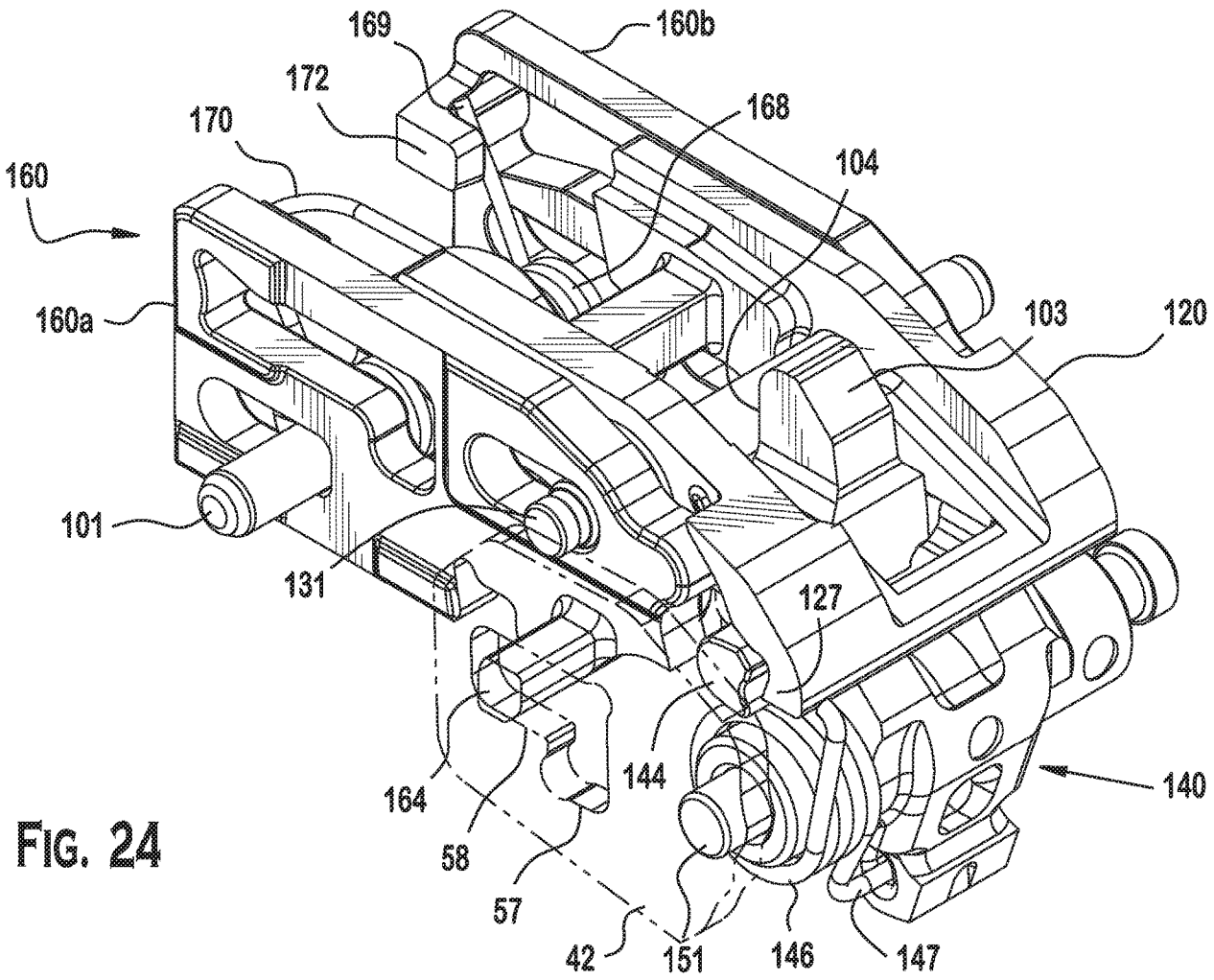
FIG. 24 is a front top perspective view thereof showing the entire firing mechanism.
Figure 26:
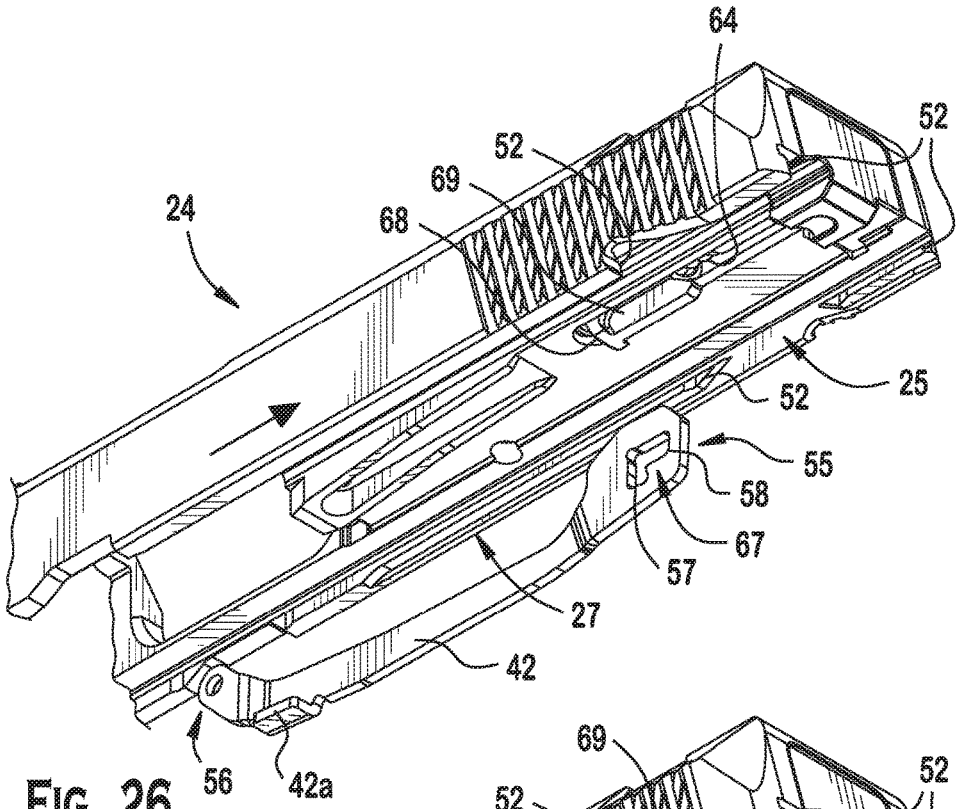
FIG. 26 is a bottom perspective view showing the trigger bar and bottom striker catch protrusion in a first position relative to the slide.
Figure 27:
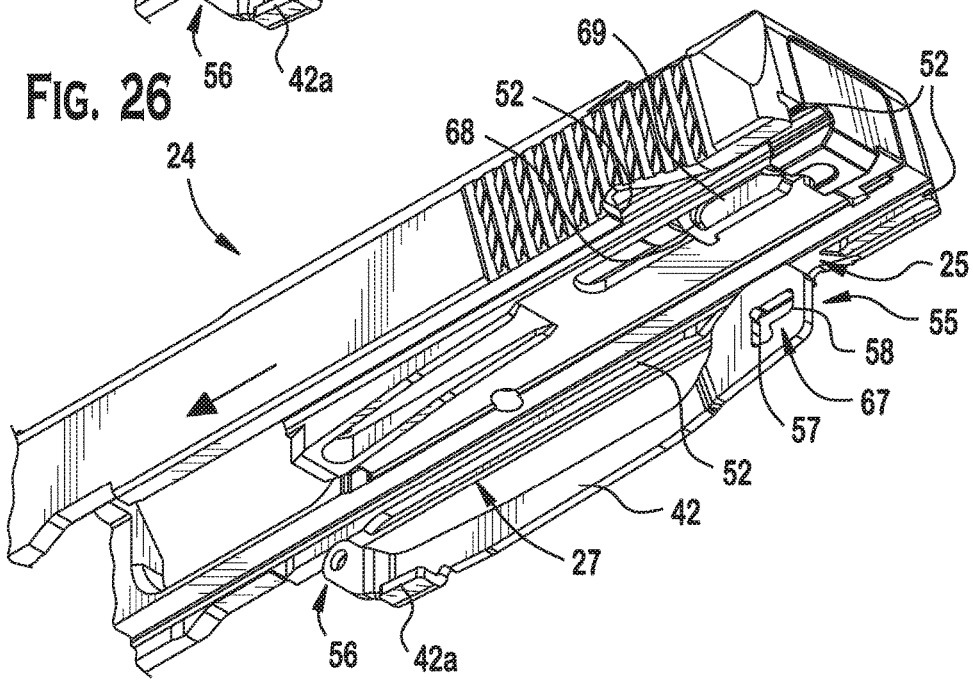
FIG. 27 is a bottom perspective view showing the trigger bar and bottom striker catch protrusion in a second position relative to the slide.
Figure 28:
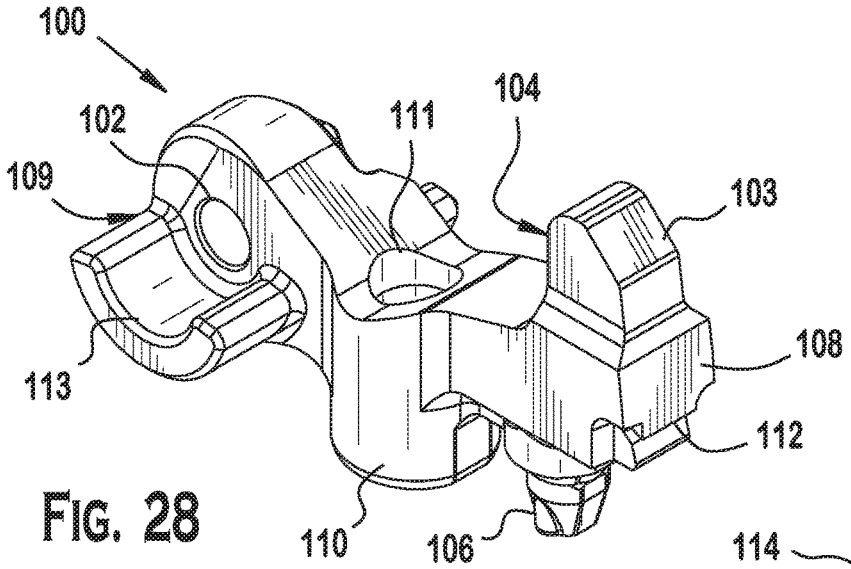
FIG. 28 is a front top perspective view of the sear.

It should be noted that the rearward motion of the slide 24 under recoil described above also moves the trigger bar 42 from the upward position (see, e.g. FIG. 27) to the downward position (see, e.g. FIG. 26). As slide 24 moves rearward, top portion of bulbous rear end 55 of trigger bar 42 leaves pocket 25 and is engaged by the right bottom surface 27 of slide 24 which pushes the trigger bar down. This causes actuating post 164 of sear connector actuator 160 to leave the trigger bar operating window notched portion 57 and travel upwards into and rearward in slotted portion 58 as shown in FIG. 21 (as the user still pulls the trigger rearward to a full trigger pull position thereby moving the trigger bar the maximum distance forward and conversely post 164 rearward in slotted portion 58 to the position illustrated in this figure). In one embodiment, the top portion of trigger bar bulbous rear end 55 may include a forward downward sloping rounded surface to provide a smooth transition for the trigger bar to leave pocket 25 and engage slide right bottom surface 27 to avoid hang-ups. The slide right bottom surface 27 in the front of pocket 25 may further have an upward and rearward angled mating surface to further ease the transitory motion. The rear angled surface of pocket 25 is intended to push the trigger bar 42 down when disassembling the slide 24 from the pistol 20 and does not have any bearing on the actual firing other than it is far enough back to allow the trigger bar to achieve its maximum height.

Figure 25:
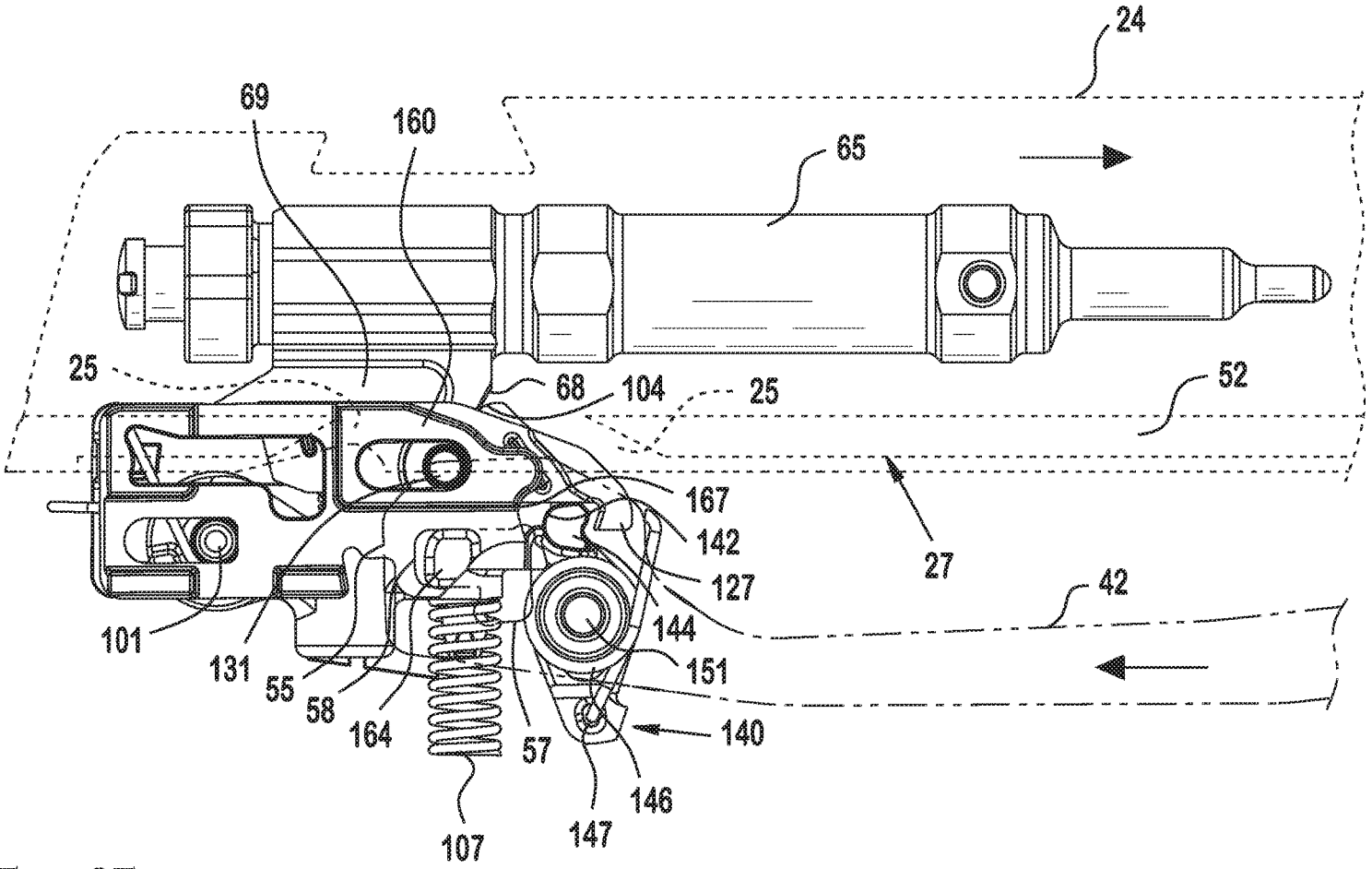
FIG. 25 is a right side view of the striker and the firing mechanism in a fifth operational position.

Slide 24 continues to travel rearward under recoil and eventually stops its rearward motion. The slide is then returned fully forwarded into battery with the rear end of barrel 26 by recoil spring 29 (shown in FIG. 2), which recloses the breech area. As shown in FIG. 25, the pocket 25 in slide 24 concomitantly has moved forward with the slide and returns to the pre-firing position with the pocket 25 now again being axially positioned above the slide pocket. As shown, however, the trigger bar 42 remains in the downward position because the user has not fully released the trigger forward at this point. The actuating post 164 of sear connector actuator 160 therefore remains rearward in operating window slotted portion 58, which prevents upward movement of trigger bar 42 via engagement between the actuating post 164 and the top surface in slotted portion 58.

The user next releases the trigger 40 which moves fully forward thereby in turn pushing the trigger bar rearward. Actuating post 164 of sear connector actuator 160 moves forward in slotted portion 58 of trigger bar operating window 67 during this motion. Once the trigger bar moves rearward enough, the notched portion 57 of operating window 67 vertically aligns with post 164 now located above the notched portion. The trigger bar 42 is then able to pop back up due to the biasing action and torque of the trigger bar spring 44 (see FIGS. 9 and 27). The trigger bar 42 rotates up once its rearward motion is sufficient for slot 58 of the trigger bar to slide to the rear of post 164 and notched portion 57 gives room for the trigger bar to rotate up. This rotating up of the trigger bar 42 re-engages the trigger bar notched portion 57 with post 164. The trigger mechanism is now fully reset and the pistol firing control mechanism is returned to the ready-to-fire position shown in FIGS. 9-12. Pistol 20 is now readied for firing the next round.

FIG. 66 is a chart showing the trigger pull force breakdown of the two-stage firing mechanism described above. The present firing mechanism with safety blocker system provides several advantages including without limitation: 1. very short trigger stroke for a striker pistol; 2. a mechanism having high mechanical advantage, which allows use of a stronger striker spring than other striker guns, which enhances cartridge ignition reliability due to higher striker kinetic energy; 3. a mechanism configurable for light to heavy trigger pulls with changes to interface angles between striker and sear, and sear and sear connector; 4. a second stage which is very short and has a feel similar to a single action pistol; and blocker system more effective than a traditional striker/firing pin block system, because the sear connector blocker 120 is balanced and works in all attitudes where inertial forces work against pulling the trigger.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. An auto-loading firearm with a firing control mechanism comprising:

a longitudinal axis;

a frame;

a barrel supported by the frame and defining a chamber for holding a cartridge;

a trigger mechanism including a trigger movably mounted to the frame;

a spring-biased striker movable axially along the longitudinal axis in a linear path between a rearward cocked position and a forward firing position for striking a chambered cartridge;

a sear pivotably movable between an engaged position that holds the striker in the cocked position and a release position that releases the striker from the cocked position to fire the firearm;

a sear connector operably linked to the firing mechanism and pivotably movable into and out of engagement with the sear, the sear connector biased into engagement with the sear which prevents movement of the sear;

the sear when disengaged by the sear connector via operation of the trigger mechanism pivotably moving to release the striker for firing the firearm;

a sear connector blocker operably coupled to the trigger mechanism and movable into and out of engagement with the sear connector, the sear connector blocker being movable via operation of the trigger between a blocking position preventing movement of the sear connector and a non-blocking position allowing the sear connector to move and disengage the sear;

wherein pulling the trigger moves the sear connector blocker from the blocking position to the non-blocking position and disengages the sear connector from the sear which is released to discharge the firearm;

wherein the sear connector blocker is pivotably movable about a first pivot axis and biased into the blocking position;

wherein the sear connector blocker comprises a front downwardly biased and projecting hooked portion configured to engage an upwardly projecting operating arm of the sear connector to prevent the sear connector from moving and disengaging the sear.

2. The firearm according to claim 1, wherein the hooked portion of the sear connector blocker includes a rear facing blocking surface axially aligned with a mating front facing blocking surface on the operating arm of the sear connector when the sear connector blocker is in the blocking position.

3. The firearm according to claim 2, wherein pulling the trigger pivots the hooked portion of the sear connector blocker upwards which moves the rear facing blocking surface out of alignment with the front facing blocking surface to allow the sear connector to rotate and disengage the sear for discharging the firearm.

4. The firearm according to claim 2, wherein attempting to move the sear connector without pulling the trigger engages the rear and front facing blocking surfaces to prevent the sear connector from rotating out of engagement with the sear to prevent discharging the firearm.

5. The firearm according to claim 1, further comprising a longitudinally movable sear connector actuator operably coupled to the trigger mechanism, the sear connector actuator configured and operable via operation of the trigger to engage and move the sear connector blocker from the blocking position to the non-blocking position.

6. The firearm according to claim 5, wherein the sear connector actuator includes a laterally extending actuating post which engages a slot formed in a trigger bar coupled to the trigger for moving the sear connector blocker.

7. The firearm according to claim 5, wherein the sear connector actuator includes a curved cam follower surface which slideably engages a cam surface on the sear connector blocker that moves the sear connector blocker to the non-blocking position.

8. The firearm according to claim 5, wherein pulling the trigger raises the front hooked portion of the sear connector blocker to prevent engagement with the operating arm of the sear connector.

9. The firearm according to claim 5, wherein the sear connector actuator is further configured and operable to engage and rotate the sear connector to disengage and release the sear for discharging the firearm.

10. The firearm according to claim 9, wherein the sear connector actuator further includes a cam surface which engages a cam follower surface on the sear connector that moves the sear connector to release the sear.

11. The firearm according to claim 9, wherein the sear connector actuator is further configured and operable to move the sear connector blocker from the blocking position to the non-blocking position before disengaging the sear connector from the sear.

12. The firearm according to claim 1, wherein the sear connector includes a flat latching surface which engages a mating latching edge on the sear.

13. The firearm according to claim 1, wherein the sear connector blocker is positioned above the sear and includes a longitudinally-extending slot and the sear includes a sear catch protrusion which projects upward through the slot.

14. The firearm according to claim 13, wherein the sear connector blocker includes a longitudinally elongated right side and a left side laterally spaced apart on each side of the slot.

15. The firearm according to claim 1, further comprising a spring mounted and acting directly between the sear and sear connector blocker which biases the sear connector blocker towards the blocking position.

16. An auto-loading firearm with a firing control mechanism comprising:

a longitudinal axis;

a frame;

a barrel supported by the frame and defining a chamber for holding a cartridge;

a trigger mechanism including a trigger movably mounted to the frame;

a spring-biased striker movable axially along the longitudinal axis in a linear path between a rearward cocked position and a forward firing position for striking a chambered cartridge;

a sear pivotably movable between an engaged position that holds the striker in the cocked position and a release position that releases the striker from the cocked position to fire the firearm;

a sear connector operably linked to the firing mechanism and pivotably movable into and out of engagement with the sear, the sear connector biased into engagement with the sear which prevents movement of the sear;

the sear when disengaged by the sear connector via operation of the trigger mechanism pivotably moving to release the striker for firing the firearm;

a sear connector blocker operably coupled to the trigger mechanism and movable into and out of engagement with the sear connector, the sear connector blocker being movable via operation of the trigger between a blocking position preventing movement of the sear connector and a non-blocking position allowing the sear connector to move and disengage the sear;

wherein pulling the trigger moves the sear connector blocker from the blocking position to the non-blocking position and disengages the sear connector from the sear which is released to discharge the firearm;

wherein the sear connector blocker comprises an axially elongated body including a right side, a left side, a longitudinal slot therebetween, and a lateral cross piece coupling the sides together, and wherein the sear connector blocker is in a substantially horizontal orientation when in the blocking position and a tilted orientation when in the non-blocking position.

17. A firing control assembly for an auto-loading firearm, the assembly comprising:

a longitudinal axis;

a firing control housing configured for insertion into a frame of a firearm;

a sear disposed in the firing control housing and pivotably movable about a first transversely oriented pivot pin, the sear including an upwardly extending catch protrusion arranged and operable to selectively engage a striker movable along the longitudinal axis in a linear path from a rearward cocked position to a forward firing position for striking a chambered cartridge;

the sear rotatable between an upright engaged position to hold the striker in the cocked position and a downward release position to release the striker from the cocked position to discharge the firearm;

a sear connector disposed in the firing control housing and pivotably movable about a second transversely oriented pivot pin, the sear connector including an upwardly projecting operating arm and a latching surface biased rearward into engagement with the sear to prevent movement thereof;

a sear connector blocker disposed in the firing control housing and pivotably movable about a transversely oriented third pivot pin, the sear connector blocker including a front downwardly projecting hooked portion configured and arranged to selectively engage the upwardly projecting operating arm of the sear connector;

the sear connector blocker being movable between a blocking position engaging and preventing movement of the sear connector and a non-blocking position disengaging and allowing movement of the sear connector to disengage the sear;

a sear connector actuator linearly movable in the firing control housing along the longitudinal axis between a rearward axial position and a forward axial position, the sear connector actuator engageable with the sear connector and sear connector blocker;

wherein linearly moving the sear connector actuator from the rearward to the forward axial position engages and moves the sear connector blocker from the blocking position to the non-blocking position, and further engages and moves the sear connector to disengage the sear which rotates to release the striker.

18. The firing control assembly according to claim 17, wherein moving the sear connector actuator to the forward axial position engages the sear connector actuator with the operating arm of the sear connector which rotates the sear connector and disengages the sear.

19. The firing control assembly according to claim 18, wherein moving the sear connector actuator to the forward axial position engages and raises the hooked portion of the sear connector blocker which rotates and disengages the sear connector thereby moving the sear connector blocker from the blocking position to the non-blocking position.

20. The firing control assembly according to claim 19, wherein the hooked portion of the sear connector blocker includes a rear facing angled cam surface which engages a front facing curved cam surface on the sear connector actuator which operates to raise the hooked portion of the sear connector blocker.

21. The firing control assembly according to claim 20, wherein the hooked portion of the sear connector blocker further includes a rear facing blocking surface which is axially aligned with and positioned to engage a front facing blocking surface on the operating arm of sear connector when the sear connector blocker is in the blocking position.

22. The firing control assembly according to claim 18, wherein each of the first, second, and third pivot pins extend through axially elongated slots formed in the sear connector actuator which allow linear movement of the sear connector actuator relative to the pins.

23. A method for discharging a firearm comprising:

providing a firearm including a frame, a barrel with a chamber configured for holding a cartridge, a spring-biased striker movable forward and rearward in a linear path along a longitudinal axis, a trigger mechanism comprising a trigger, a pivotable sear, a pivotable sear connector engaged with the sear, a pivotable sear connector blocker engaged with the sear connector, and a linearly movable sear connector actuator engageable with the sear connector and sear connector blocker;

engaging the sear with the striker to hold the striker in a rearward cocked position;

actuating the trigger;

sliding the sear connector actuator in an axial direction;

engaging and rotating the sear connector blocker with the sear connector actuator which disengages the sear connector;

further sliding the sear connector actuator in the axial direction;

engaging and rotating the sear connector with the sear connector actuator which disengages the sear after the sear connector actuator engages the sear connector blocker;

rotating the sear which disengages the striker; and moving the striker forward for striking a cartridge in the chamber.

* * * * *